US009105204B2

(12) United States Patent
Heinrichs

(10) Patent No.: US 9,105,204 B2
(45) Date of Patent: Aug. 11, 2015

(54) LABELING TAG WITH EXPANDABLE LOOP AND POCKET, AND METHOD OF MANUFACTURE

(75) Inventor: Curtis John Heinrichs, Sibley, IA (US)

(73) Assignee: Bedford Industries, Inc., Worthington, MN (US)

( * ) Notice: Subject to any disclaimer, the term of this patent is extended or adjusted under 35 U.S.C. 154(b) by 128 days.

(21) Appl. No.: 13/885,356

(22) PCT Filed: Nov. 18, 2011

(86) PCT No.: PCT/US2011/061306

§ 371 (c)(1), (2), (4) Date: May 14, 2013

(87) PCT Pub. No.: WO2012/071252

PCT Pub. Date: May 31, 2012

(65) Prior Publication Data

US 2013/0239449 A1 Sep. 19, 2013

Related U.S. Application Data

(60) Provisional application No. 61/522,100, filed on Aug. 10, 2011, provisional application No. 61/416,129, filed on Nov. 22, 2010.

(51) Int. Cl.
*G09F 3/20* (2006.01)
*G09F 3/04* (2006.01)
(Continued)

(52) U.S. Cl.
CPC .. *G09F 3/04* (2013.01); *G09F 3/14* (2013.01); *G09F 2003/027* (2013.01); *G09F 2003/0272* (2013.01); *Y10T 156/1084* (2015.01)

(58) Field of Classification Search
CPC ..... G09F 3/14; G09F 3/20; G09F 3/202; G09F 31/10; G09F 2003/0272; B65D 5/28; A45F 2005/008
USPC ..... 40/669, 668, 665, 306, 373, 310, 40/654.01; 229/105, 87.03; 224/222
See application file for complete search history.

(56) References Cited

U.S. PATENT DOCUMENTS 1,184,311 A * 5/1916 Boch ..... 224/222
1,397,079 A * 11/1921 Cohen ..... 40/665
(Continued)

FOREIGN PATENT DOCUMENTS

| | | |
|---|---|---|
| GB | 2351961 | 1/2001 |
| WO | 9641321 | 12/1996 |
| WO | 2007/084119 | 7/2007 |

OTHER PUBLICATIONS

International Search Report dated Mar. 29, 2012 from International Application No. PCT/US2011/061305.

*Primary Examiner* — Casandra Davis
(74) *Attorney, Agent, or Firm* — James L. Young; Westman Champlin & Koehler, P.A.

(57) ABSTRACT

A labeling tag (10, 210, 410, 510, 610, 710), comprising a tag portion (12, 212, 412, 512, 612, 712), and a film (28, 228, 428, 528, 628, 728) disposed over the tag portion (12, 212, 412, 512, 612, 712) and bonded to the tag portion (12, 212, 412, 512, 612, 712) at multiple locations to define a pocket (16, 216, 416, 516, 616, 716) between the film and the tag portion (12, 212, 412, 512, 612, 712). The labeling tag (10, 210, 410, 510, 610, 710) further comprising an elastomer portion (14, 214, 414, 514, 614, 714) secured to the tag portion (12, 212, 412, 512, 612, 712), and having an expandable loop (34, 234, 434, 534, 634, 734).

6 Claims, 30 Drawing Sheets

(51) Int. Cl.
*G09F 3/14* (2006.01)
*G09F 3/02* (2006.01)

(56) References Cited

U.S. PATENT DOCUMENTS 1,651,921 A * 12/1927 Felz ..... 224/240
1,984,559 A * 12/1934 Wilcox ..... 229/74
2,203,155 A * 6/1940 Jullien et al. ..... 40/665
4,201,299 A * 5/1980 Bumgarner et al. ..... 206/554
5,092,513 A * 3/1992 Arbonies ..... 229/68.1
6,688,023 B1 * 2/2004 Gwen ..... 40/1.6
D532,049 S 11/2006 Ludlow
7,281,345 B2 10/2007 Ludlow et al.
D623,852 S * 9/2010 Kroll ..... D3/226
7,836,622 B1 11/2010 King et al.

* cited by examiner

LABELING TAG WITH EXPANDABLE LOOP AND POCKET, AND METHOD OF MANUFACTURE

CROSS-REFERENCE TO RELATED APPLICATION

This Application is a Section 371 National Stage Application of International Application No. PCT/US2011/061306, filed Nov. 18, 2011, and published as WO2012/071252 on May 31, 2012, in English, which is a non provisional of U.S. Provisional Patent Application No. 61/416,129, filed Nov. 22, 2010, and U.S. Provisional Patent Application No. 61/522,100, filed Aug. 10, 2011, the contents of which are hereby incorporated by reference in their entirety.

BACKGROUND

The present disclosure relates to a labeling tag and in particular to a labeling tag with an expandable loop and a pocket, and a method for manufacturing the labeling tag.

Tags can be fastened to various manufactured products and other articles to convey information. Such tags can be preprinted with text or other information or include other indicia or distinguishing features. Depending upon the application and design, tags are attached to various articles using different attachments. Often times the attachment or tag may be difficult to remove from the article or product, or the tag may not meet the specification requirements for the product or article.

SUMMARY

An aspect of the present disclosure is directed to a labeling tag that includes a tag portion, a film, and an elastomer portion. The film is disposed over the tag portion and is bonded to the tag portion at multiple locations to define a pocket between the film and the tag portion, where the pocket also has an inlet opening at which the film is unbonded to the tag portion. The elastomer portion includes a bonding segment secured to the tag portion, a transition portion extending from the bonding segment, and an expandable loop extending from the transition portion.

Another aspect of the present disclosure is directed to a labeling tag that includes a foldable tag portion, a film, and an elastomer portion. The foldable tag portion includes a front segment, and a rear segment integrally connected to the front segment at a fold line, wherein the rear segment comprises a front surface and a rear surface. The film is bonded to the front surface of the rear segment to define a pocket between the film and the front surface, where the pocket has an inlet opening located adjacent to the fold line at which the film is unbonded to the front surface. The elastomer portion is secured to the rear surface of the rear segment, and includes an expandable loop.

Another aspect of the present disclosure is directed to a method for manufacturing multiple labeling tags. The method includes advancing a web of a tag material in a longitudinal direction, where the web has a front surface and a rear surface, and laminating a film over a first segment of the front surface of the web, where a second segment of the web is free of the laminated film. The method also includes bonding portions of the film to the front surface of the web to define multiple pockets, where each pocket has an inlet opening at which the film is unbonded to the front surface of the web, and folding the second segment of the web over the first segment of the web to define a longitudinally-extending fold line, where the folded second segment covers at least a portion of the pockets, and where the inlet openings of the pockets are located adjacent to the longitudinally-extending fold line. The method further includes laminating an elastomer film to the rear surface of the web to form a bonding zone between the elastomer film and the rear surface of the web adjacent to the longitudinally-extending fold line, cutting the laminated elastomer film to form multiple expandable loops, and forming lines of weakness in the front and rear segments of the web and in the bonded film to define the multiple labeling tags, where each of the multiple labeling tags includes one of the pockets and one of the expandable loops.

This summary is provided to introduce a selection of one or more concepts in a simplified form that are further described below in the Detailed Description. This summary is not intended to identify key features or essential features of the claimed subject matter, is not intended to describe each disclosed embodiment or every implementation of the claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure is referred to by like reference numerals throughout the several views.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

DETAILED DESCRIPTION

The present disclosure is directed to labeling tags having tag portions and expandable loops, where the tag portions have pockets or pouches to retain various items. As discussed below, in some embodiments, the labeling tags are foldable tags having foldable tag portions that are configured to fold over the pocket. The labeling tags of the present disclosure may have a variety of applications. For example, the labeling tags may be used as product tags for labeling food products or other retail products, as well as gift tags for packages, or as a means to attach a product sample or information to an article (e.g., to facilitate the article's sale, storage, identification, transport, etc.). Although the present disclosure recites a variety of illustrative uses the labeling tags, use is not limited to the specific applications described.

Figure 1A:
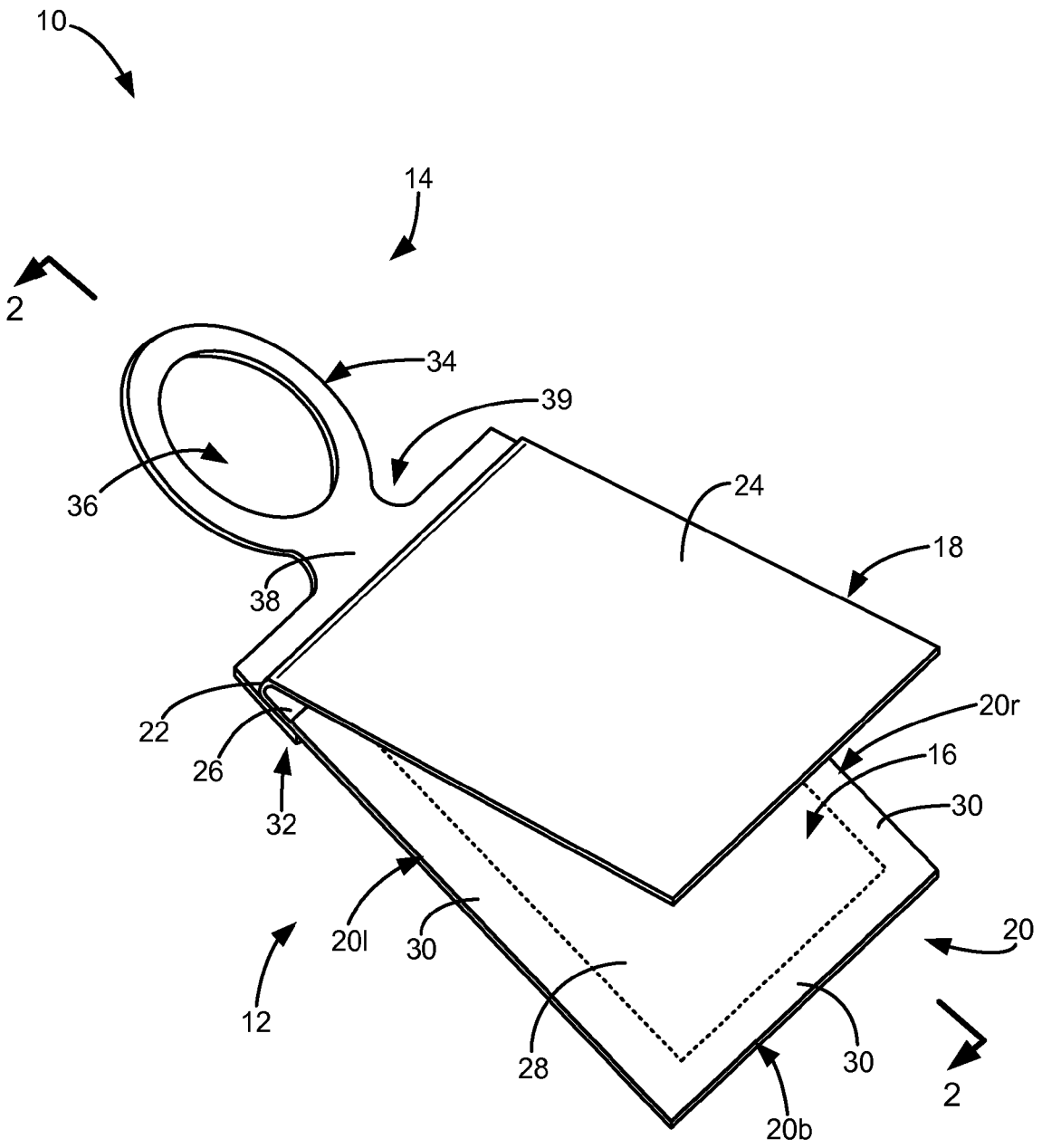
FIG. 1A is a perspective illustration of a foldable tag of the present disclosure having an expandable loop and a pocket, where the foldable tag is in a partially-opened state.

As shown in FIG. 1A, foldable tag 10 is an example of a first embodied labeling tag of the present disclosure. Foldable tag 10 includes tag portion 12 and elastomer portion 14, where tag portion 12 includes pocket 16. As discussed below, pocket 16 is suitable for retaining one or more removable items, such as coupons, advertisements, product samples, and the like. This allows foldable tag 10 to display information on tag portion 12, and include additional, removable items in pocket 16. As such, even after foldable tag 10 is manufactured and tag portion 12 retains fixed printed indicia and graphics, items may be interchangeably inserted into and retained by pocket 16, such as updated coupons or advertisements.

For example, pocket 16 may retain an instant coupon for product sales, a coupon for future product purchases, a mail-in product warranty registration card, a mail-in rebate, an advertisement for a related product, and the like. Alternatively, pocket 16 may be used to carry instructions for use and/or ingredients. Furthermore, the items may be folded within pocket 16, such as a folded instruction or a folded ingredient packet, which may result in less packaging overall. The incorporation of a pocket in foldable tag 10 allows foldable tag 10 to provide a variety of interchangeable sources of information and samples, which may be changed after foldable tag 10 is manufactured.

Tag portion 12 is a foldable tag portion that includes front segment 18 and rear segment 20, which are bi-fold segments integrally connected to each other and formed from a single sheet and folded at fold line 22. The sheet for front segment 18 and rear segment 20 may be derived from one or more paper, polymeric, metallic, organic, and/or fabric materials. For example, front segment 18 and rear segment 20 may be derived from one or more printable card materials, such as materials commercially available under the trade designation "TESLIN" from PPG Industries, Pittsburgh, Pa. In one embodiment, front segment 18 and rear segment 20 are formed at least in part from biodegradable, degradable, or recyclable materials. For example front segment 18 and rear segment 20 may each be fabricated from one or more polypropylene and/or styrene-based materials. Additional examples of suitable materials for front segment 18 and rear segment 20 include those recited for the tag portions in King et al., U.S. Pat. No. 7,836,622; Ludlow et al., U.S. Pat. No. 7,281,345; and Ludlow et al., International Application Publication No. WO07/084,119.

Segments 18 and 20 are folded to provide a relatively flat profile and can be opened or unfolded for viewing inner facing surfaces of segments 18 and 20, and for access to pocket 16. As shown in FIG. 1A, front segment 18 includes front surface 24, and rear segment 20 includes front surface 26. As further shown, tag portion 12 also includes film 28 secured to front surface 26 of rear segment 20 to define pocket 16 therebetween. Film 28 is bonded or otherwise adhered to front surface 26 at multiple locations around the lateral and bottom perimeter of front surface 26, represented as sealed borders 30.

In the shown embodiment, segments 18 and 20 each have a rectangular geometry with a top edge, a bottom edge, and lateral edges, where the top edges of segments 18 and 20 meet at fold line 22. In this embodiment, sealed borders 30 extend along the bottom edge of rear segment 20 (referred to as bottom edge 20*b*), along a portion of the left lateral edge of rear segment 20 (referred to as left edge 20*l*), and along a portion of the right lateral edge of rear segment 20 (referred to as right edge 20*r*).

As discussed below, film 28 is desirably unbonded to front surface 26 between sealed borders 30 to define pocket 16. Additionally film 28 is desirably unbounded to front surface 26 at the top perimeter of front surface 26, adjacent to fold line 22, to provide access to pocket 16 when tag portion 12 is opened. In some embodiments, film 28 may be temporarily secured to front surface 26 (e.g., with a temporary adhesive or other attachment mechanism) to keep pocket 16 closed until a user desires to open pocket 16.

Film 28 may be fabricated from one or more paper, polymeric, metallic, organic, and/or fabric materials. In one embodiment, film 28 is a polymeric film (e.g., a translucent or transparent polymeric film), which may be biodegradable, degradable, and/or recyclable. For example, film 28 may be fabricated from the same or similar materials as tag portion 12, such as from one or more polypropylene and/or styrene-based materials. In additional embodiments, film 28 may be perforated to allow air to pass through film 28. These embodiments are suitable for use with scented inserts (e.g., perfume samples), thereby allowing a user to readily smell the scents of the inserts by merely opening tag portion 12.

Elastomer portion 14 extends from tag portion 12 and is formed of a relatively thin sheet of one or more elastomeric materials, and is conjoined with tag portion 12 along a relatively flat bonding segment 32. In particular, flat bonding segment 32 overlaps with tag portion 12 and is bonded or otherwise secured to a rear surface of rear segment 20 (not shown in FIG. 1A). The overlapping region of flat bonding segment 32 and the rear surface of rear segment 20 is sufficient so that elastomer portion 14 does not separate from tag portion 12 during use. For example, the overlap is generally about 3/16 or 1/4 inch or even 3/8 inch, but typically not over about one inch or more, or in some embodiments, not over about 3/4 inch or more.

Suitable elastomeric materials for elastomer portion 14 include thermoplastic elastomers, such as styrenic block copolymers (e.g., styrene-butadiene styrene and styrene-ethylene-butylene styrene), olefinic elastomers (e.g., ethylene and polypropylene based polyvinyl chloride-based elastomers, urethanes, nylon, silicon, and the like. The elastomeric material(s) provide elastomer portion 14 with sufficient elasticity to be stretched and to bounce back from a stretched condition. In this shown embodiment, segments 18 and 20 of tag portion 12 are desirably more rigid than film 28 and elastomer portion 14. This may be accomplished due to combinations of layers thicknesses and material choices.

Elastomeric portion 14 includes a relatively flexible portion that extends from flat bonding segment 32 to form expandable loop 34. Expandable loop 34 is formed about an open area or cut-out area 36 of the relative flexible portion of the elastomeric portion 14. Expandable loop 34 is sized and shaped to provide sufficient expansion so expandable loop 34 can be secured about (i.e., stretched over) various articles or products depending upon the desired application or use, such as bottle 37 (shown in FIG. 1B). Although FIG. 1A illustrates a particular loop shape or design, expandable loop 34 is not limited to the particular shape or design shown. For example, expandable loop 14 can be oval, round or elongate shape depending upon the desired application and such characteristics as the elasticity of elastomeric portion 14, the width of the loop band, and the size of open area 36.

Figure 1B:
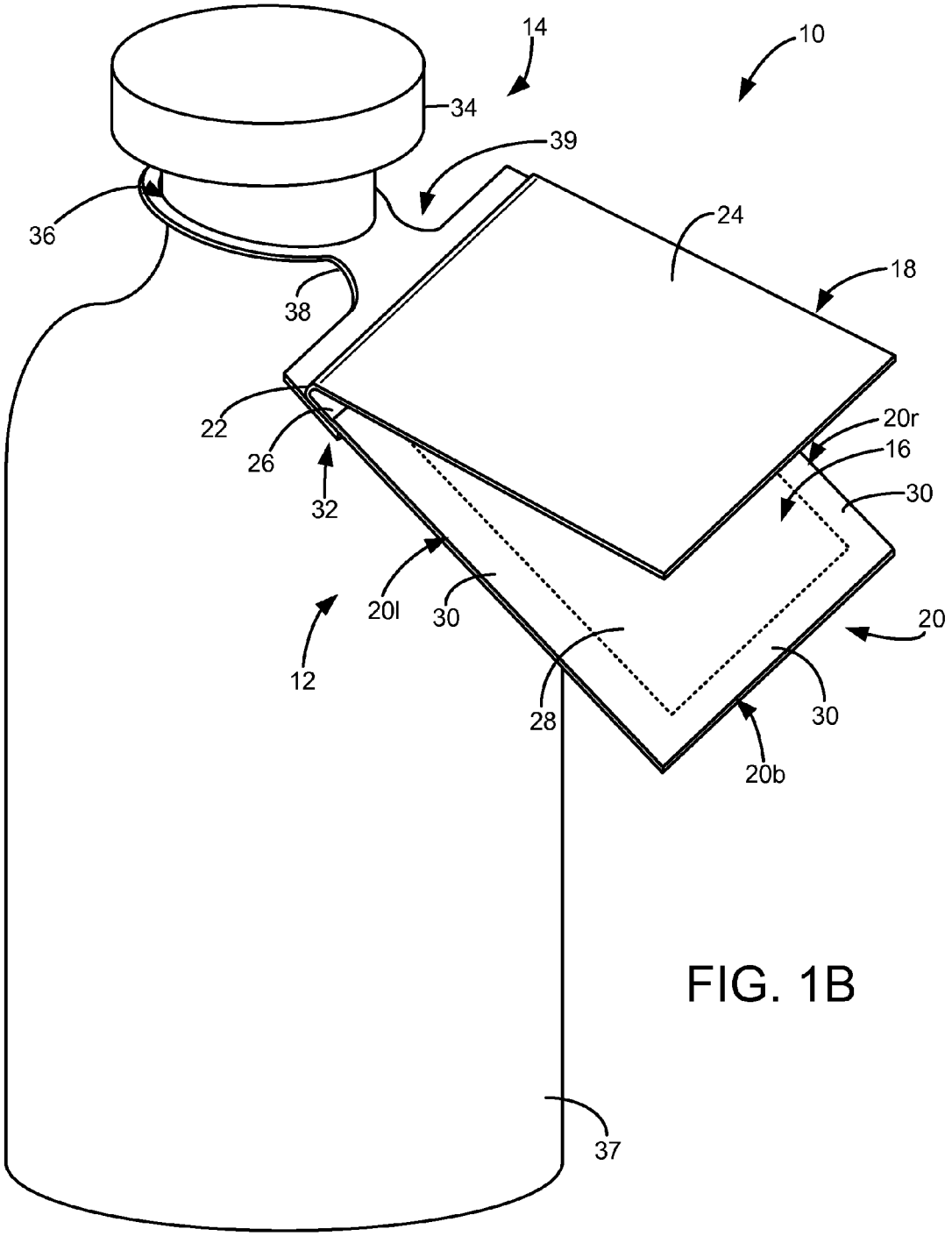
FIG. 1B is a perspective illustration of the foldable tag attached to a bottle.

As shown in FIGS. 1A and 1B, the relatively flexible portion of elastomeric portion 14 also includes transition portion 38 disposed between flat bonding segment 32 and expandable loop 34. Accordingly, transition portion 38 extends from bonding segment 32, and expandable loop 34 extends from transition portion 38. In one embodiment, transition portion 38 may include a narrowed neck portion 39 that functions to disperse tension force created as a result of the stretching or expansion of expandable loop 34.

For example, as shown in FIG. 1B, when expandable loop 34 is stretched to fit around a cap and neck of bottle 37, this results in tension forces on elastomeric portion 14. Transition portion 38 disperses the tension forces, which is desirable to reduce stress on the elastomer in flat bonding segment 32. The dimension and contour of the transition or neck portion 39 is designed based upon the size, shape and elastic characteristics of the expandable loop 34.

Figure 2:
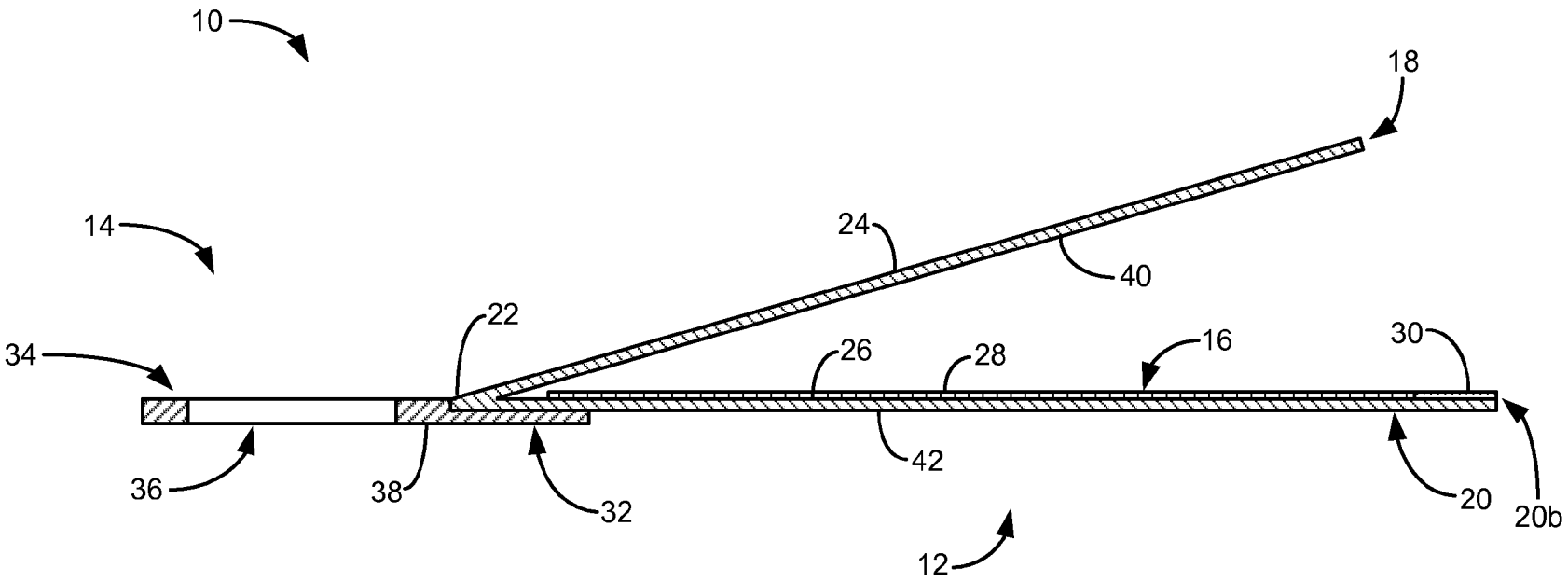
FIG. 2 is a sectional view of the foldable tag taken along Section 2-2 in FIG. 1.

As shown in FIG. 2, front segment 18 and rear segment 20 are formed of folded sections of a printable sheet, which is desirably relatively stiff in comparison to the elastomer portion 14. Front segment 18 includes rear surface 40, and rear segment 20 includes rear surface 42.

In the shown embodiment, elastomer portion 14 has a layer thickness that is greater than a thickness of the sheet forming front section 18 and rear section 20 by at least about 20 percent up to about four-six times the thickness of tag portion 12. In an illustrative embodiment the thickness of tag portion 12 is in the range of 10 mils (e.g., from about 15-20 mils in thickness) and the thickness of the elastomer portion 14 ranges from about 15 mils to about 30 mils in thickness. As shown in FIG. 2, expandable loop 34 and neck portion 36 have thicknesses that are greater than a thickness of the conjoined portion of elastomer portion 14 forming the relatively thin bonding segment 32.

The size, shape and dimensions of the expandable loop 34 desirably permit stretching of the loop to a size at least three times greater than a relaxed unstretched size. The relaxed unstretched opening may range from as little as about 1.5 inches up to illustratively 5 inches. In an illustrative embodiment, a width of a perimeter of the expandable loop 14 is in a range of about 1/10 inches (100 mils) to about 1/12 inches (50 mils) and a thickness of the expandable loop 14 is between about 0.012 inches (12 mils) and about 0.030 inches (30 mils).

Figure 3:
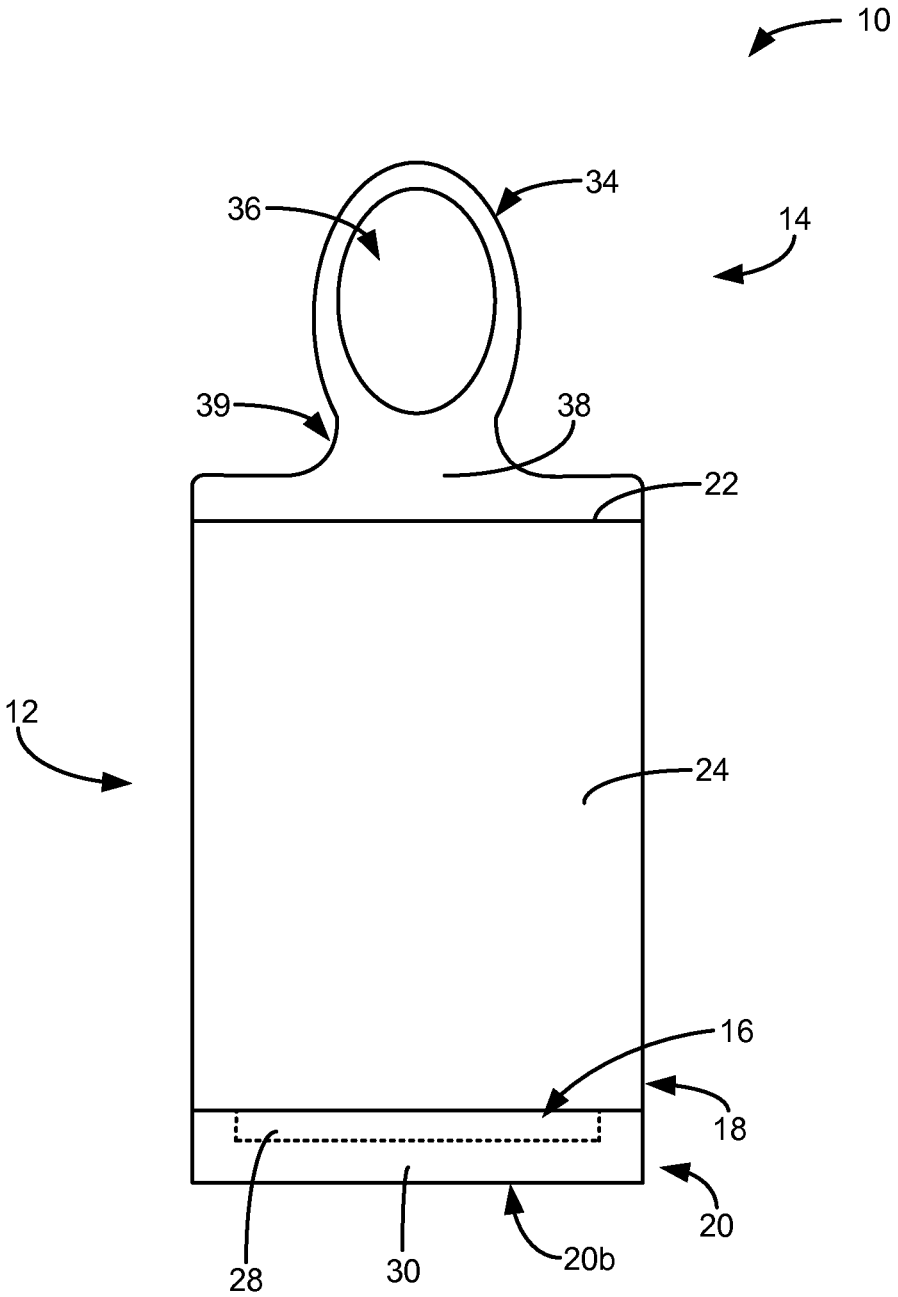
FIG. 3 is a front view of the foldable tag in a closed state.

As shown in FIG. 3, the length of rear segment 20 from elastomer portion 14 is longer than the length of front segment 18. As such, a portion of pocket 16 may be visible when foldable tag 14 is in a closed state. In alternative embodiments, however, segments 18 and 20 may exhibit a variety of different sizes, shapes and relative dimensions. For example, in one embodiment, the unbounded portions of film 28 that define pocket 16 may be substantially or entirely hidden behind front segment 18 when front segment 18 is folded closed against rear segment 20.

Figure 4:
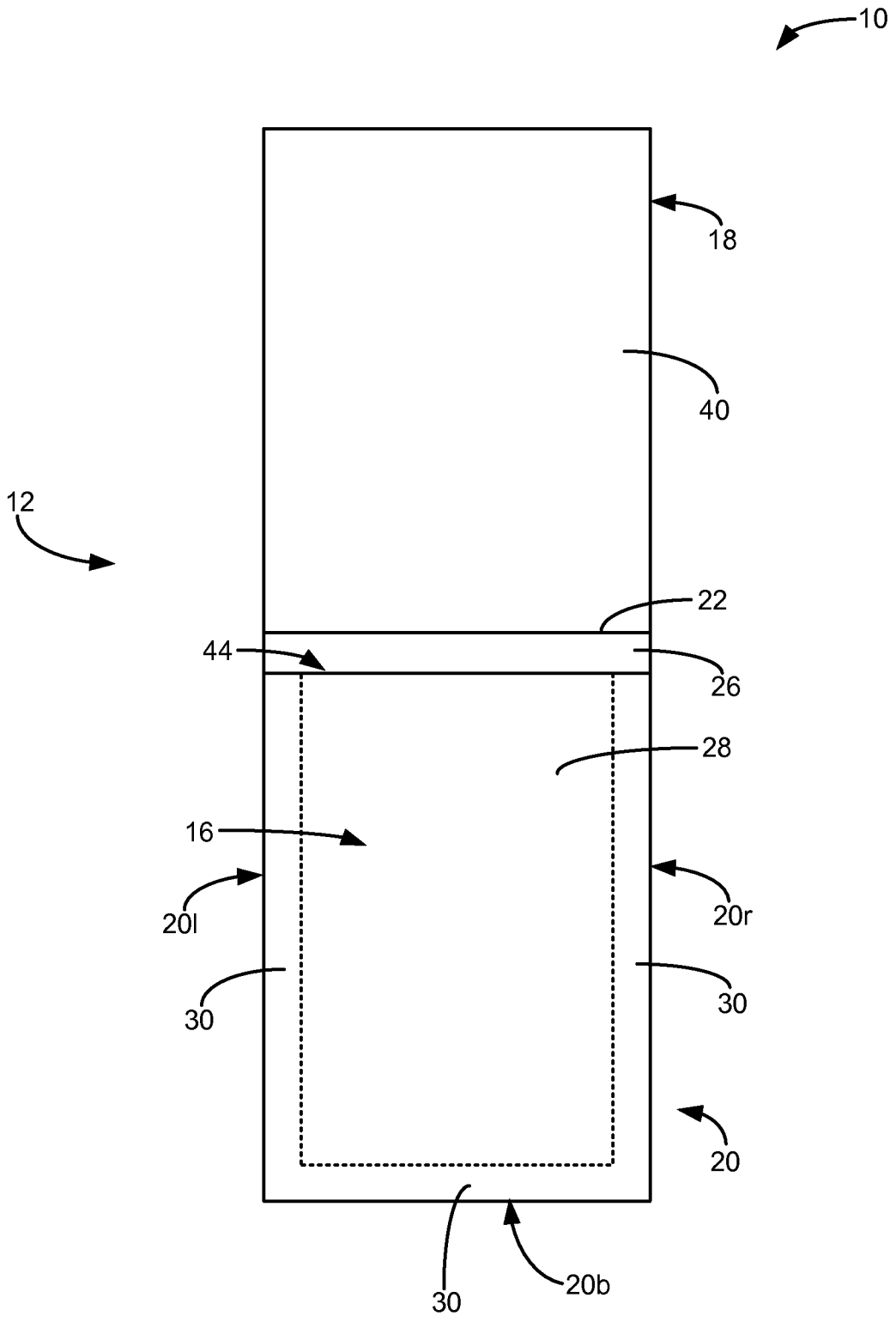
FIG. 4 is a front view of the foldable tag in a fully-opened state.

As shown in FIG. 4, when tag portion 12 is opened to a fully-opened state, pocket 16 is accessible. In particular, pocket 16 includes inlet opening 44, which is a portion of film 28 that is unbonded to front surface 26 of rear segment 20, in comparison to sealed borders 30. This allows a user to insert items into pocket 16 while tag portion 12 is in a partially-opened or fully-opened state. For example, the user may inset coupons or advertisements into pocket 16. Front segment 18 may then be closed against rear segment 20 (as shown in FIG. 3).

As shown, inlet opening 44 is located adjacent to the top edge of rear segment 20 (i.e., adjacent to fold line 22). The location of inlet opening 44 of pocket 16 relative to fold line 22 effectively prevents the item(s) retained in pocket 16 from falling out of foldable tag 10 while foldable tag 10 is closed (e.g., during storage, transportation, and display). When a user desires to remove the item(s) from pocket 16, the user may open front segment 18 to a partially-opened or fully-opened state, which then provides access to inlet opening 44, as discussed above. The user may then easily remove the item(s) from pocket 16 through inlet opening 44.

While inlet opening 44 of pocket 16 is shown below fold line 22, in alternative embodiments, pocket 16 may extend above fold line 22 such that inlet opening 44 is located along rear surface 40 of front segment 18. In this embodiment, pocket 16 may also fold along fold line 22 to provide a foldable pocket. As such, this larger pocket 16 is suitable for retaining larger items and/or may further secure items within pocket 16 by having film 28 also fold over at fold line 22.

Figure 5:
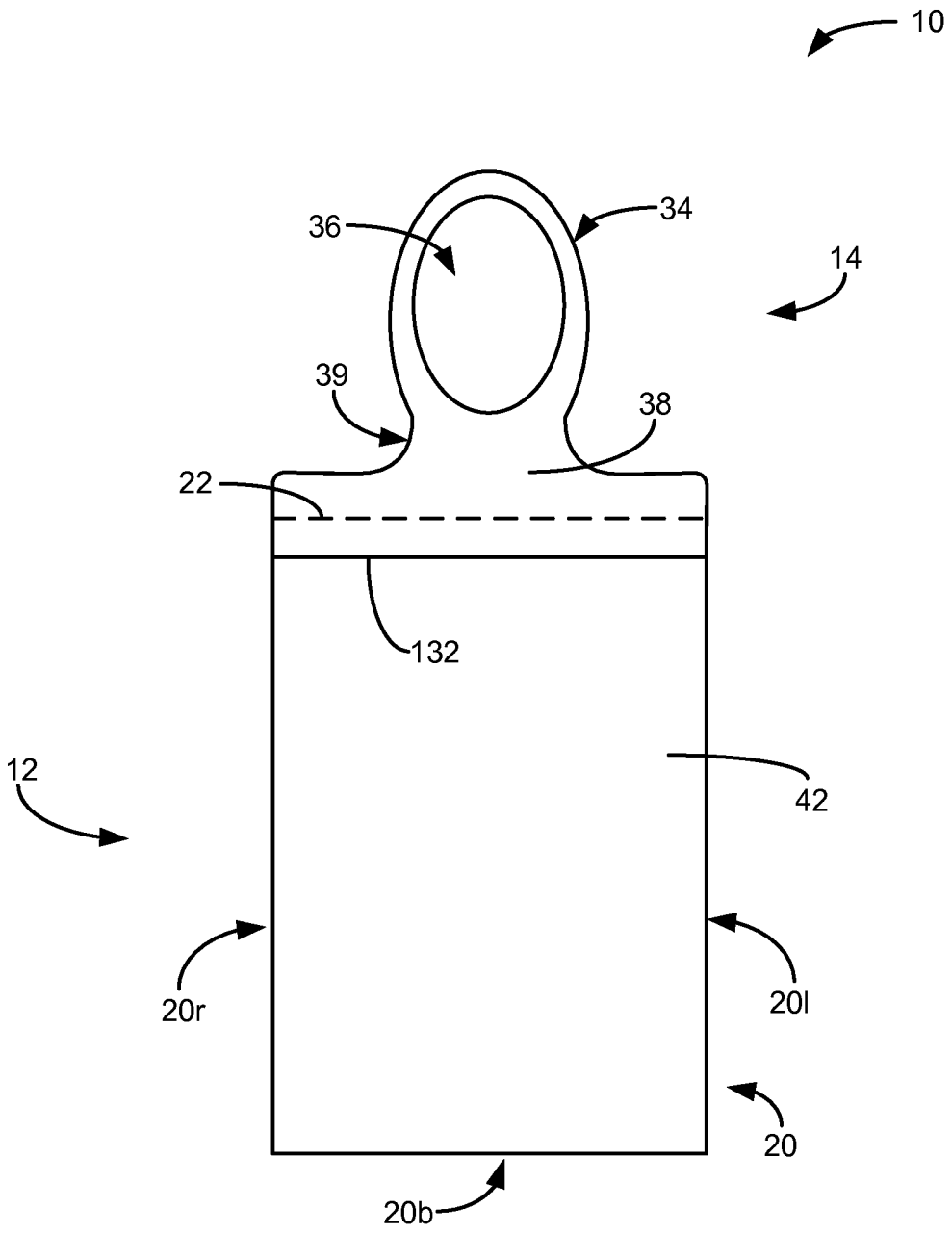
FIG. 5 is a rear view of the foldable tag in the closed state.

As shown in FIG. 5, rear surface 42 of rear segment 20 may also provide a suitable location for presenting information. As further shown, flat bonding segment 32 is bonded to a portion of rear surface 42, adjacent to fold line 22.

Foldable tag 10 may be manufactured using a variety of different techniques. Examples of suitable techniques for foldable tag 10 include those disclosed in Ludlow et al., U.S. Pat. No. 7,281,345 and Ludlow et al., International Application Publication No. WO07/084,119. Additionally, FIGS. 6A-6F illustrate a method for manufacturing multiple foldable tags 10 using a web-based process. In the example shown in FIGS. 6A-6F, the multiple foldable tags 10 are manufactured in two opposing rows, which increases production volume. In an alternative embodiment, the multiple foldable tags 10 may be manufactured in a single row.

Figure 6A:
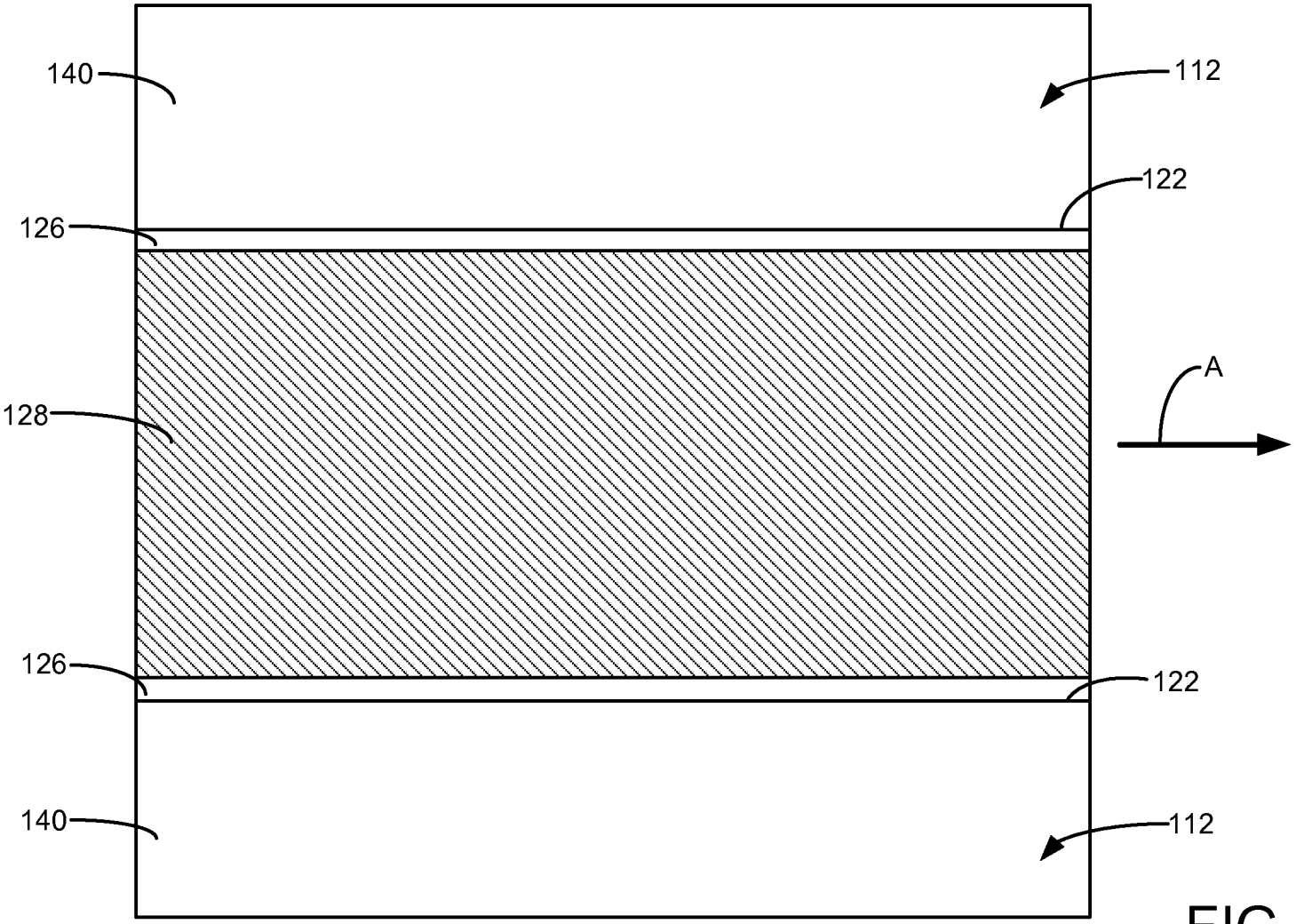
FIGS. 6A-6F are schematic illustrations of a web-based process for manufacturing multiple foldable tags of the present disclosure.

As shown in FIG. 6A, the process may initially involve advancing a web of a material for tag portion 12 (referred to as tag web 112) in the longitudinal direction of arrow A. In the shown example, tag web 112 includes fold lines 122, which correspond to the fold lines 22 for the multiple foldable tags 10. Furthermore, the shown surface of tag web 112 includes surface regions 126 and 140, which respectively correspond to front surface 26 and rear surface 40 of tag portion 12. A sheet of material for film 28 of pocket 16 (referred to as pocket film 128) may be laminated over a central portion of tag web 112.

Figure 6B:
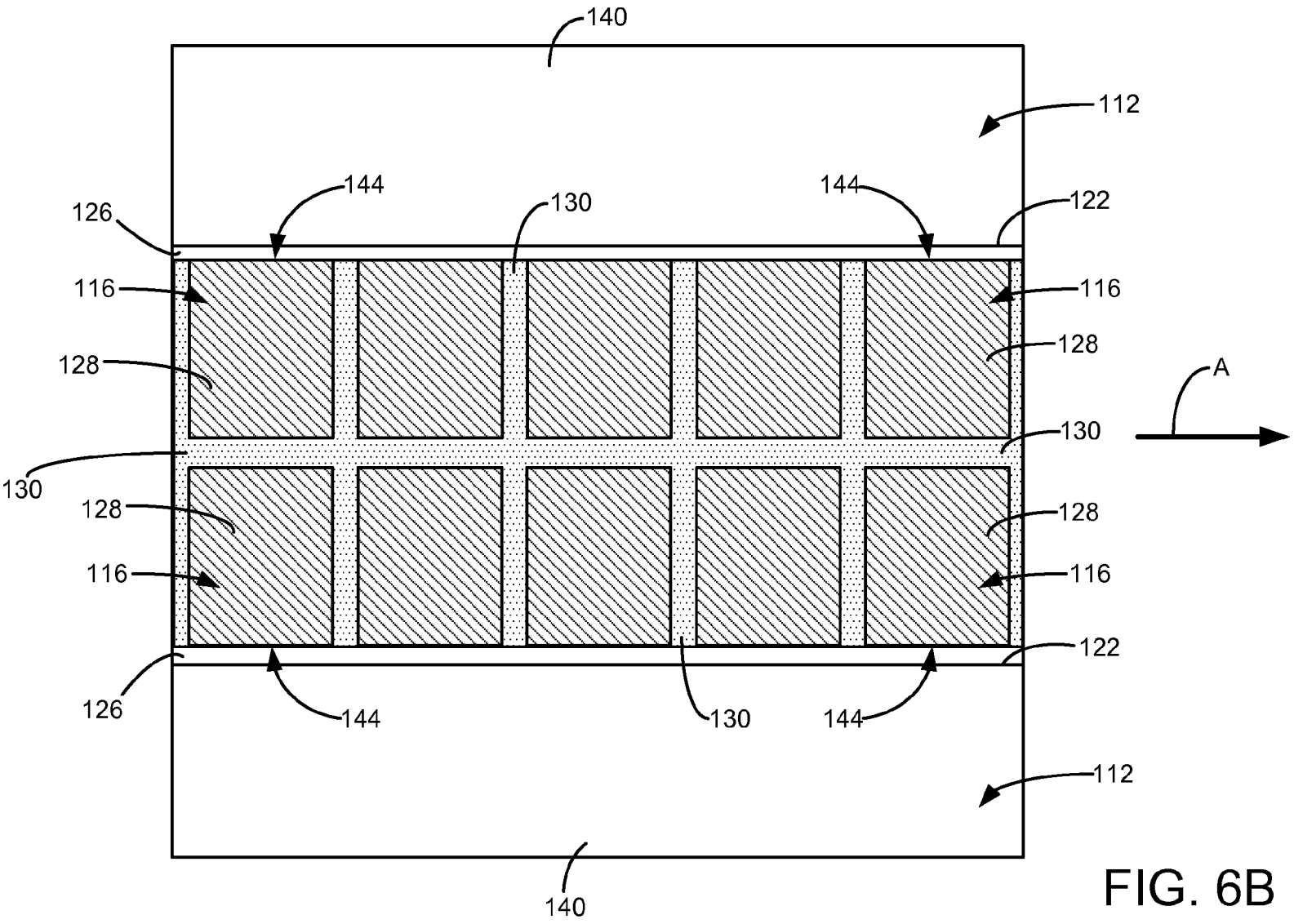

As shown in FIG. 6B, various portions of pocket film 128 may be sealed against tag web 112 to form sealed regions 130 that correspond to sealed borders 30 of foldable tag 10. In one embodiment, sealed regions 130 are formed by heat sealing pocket film 128 to tag web 112 at the shown locations, such as with a heated annular die roller or a heated die press. The extent of the heat sealing may vary depending on the materials used for tag web 112 and pocket film 128. However, the heat sealing desirably provides a good heat seal bond at seal regions 130 that prevent delamination under normal conditions of use. In alternative embodiments, tie layers may be used to provide adhesive bonding in addition to, or as an alternative to heat sealing. In further alternative embodiments, other suitable sealing techniques, such as ultrasonic sealing, may be used. In one embodiment, the heating sealing step shown in FIG. 6B may be performed at the same time, or at substantially the same time, as the lamination of pocket film 128 over tab web 112.

Heat sealing pocket film 128 in this manner creates multiple pockets in the advancing web (referred to as pockets 116), which correspond to pockets 16 for multiple foldable tags 10. As further shown, sealed regions 130 extend only around the lateral sides and bottom of each pocket 116, providing an inlet opening 144 for each pocket 116. While pockets 116 are illustrated as being rectangular in shape, in alternative embodiments, the healing sealing may define pockets 116 with a variety of different geometries.

If desired, one or more items may also be inserted into the formed pockets 116 at this point in the manufacturing process. For example, coupons or product samples may be inserted into pockets 116 as the advancing web moves in the direction of arrow A. To accommodate the line speed of the advancing web, the insertion step is desirably performed in an automated manner. However, the one or more items may alternatively be manually inserted into pockets 116. Alternatively, users (e.g., customers) may insert items into pockets 16 of the multiple foldable tags 10 after the manufacturing process is completed.

Figure 6C:
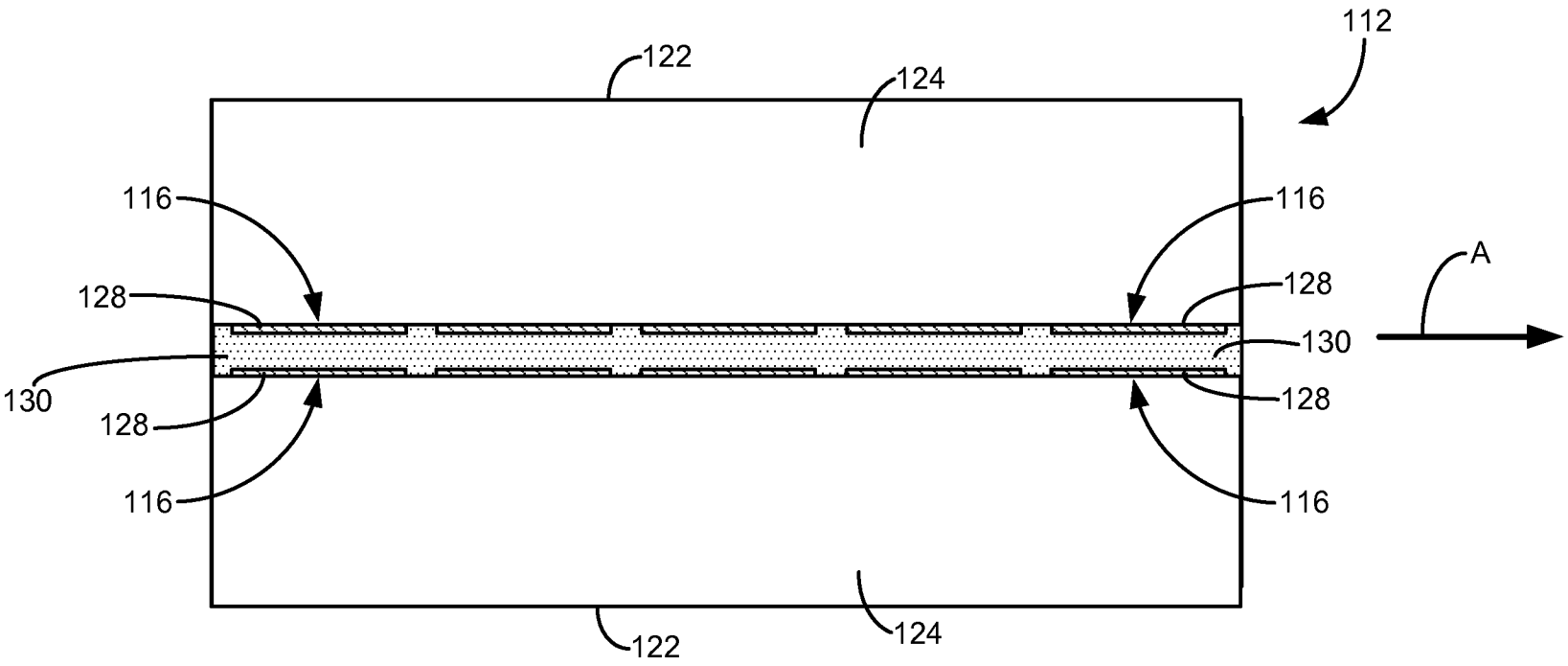

As shown in FIG. 6C, tag web 112 may then be folded at fold lines 122, which are longitudinally-extending fold lines, such that surface region 140 is folded closed against pockets 116. As such, surface regions 124, corresponding to front surface 24 of foldable tag 10, are shown. As can appreciated, this folded arrangement positions inlet openings 144 of each pocket 116 adjacent to one of the fold lines 122.

Figure 6D:
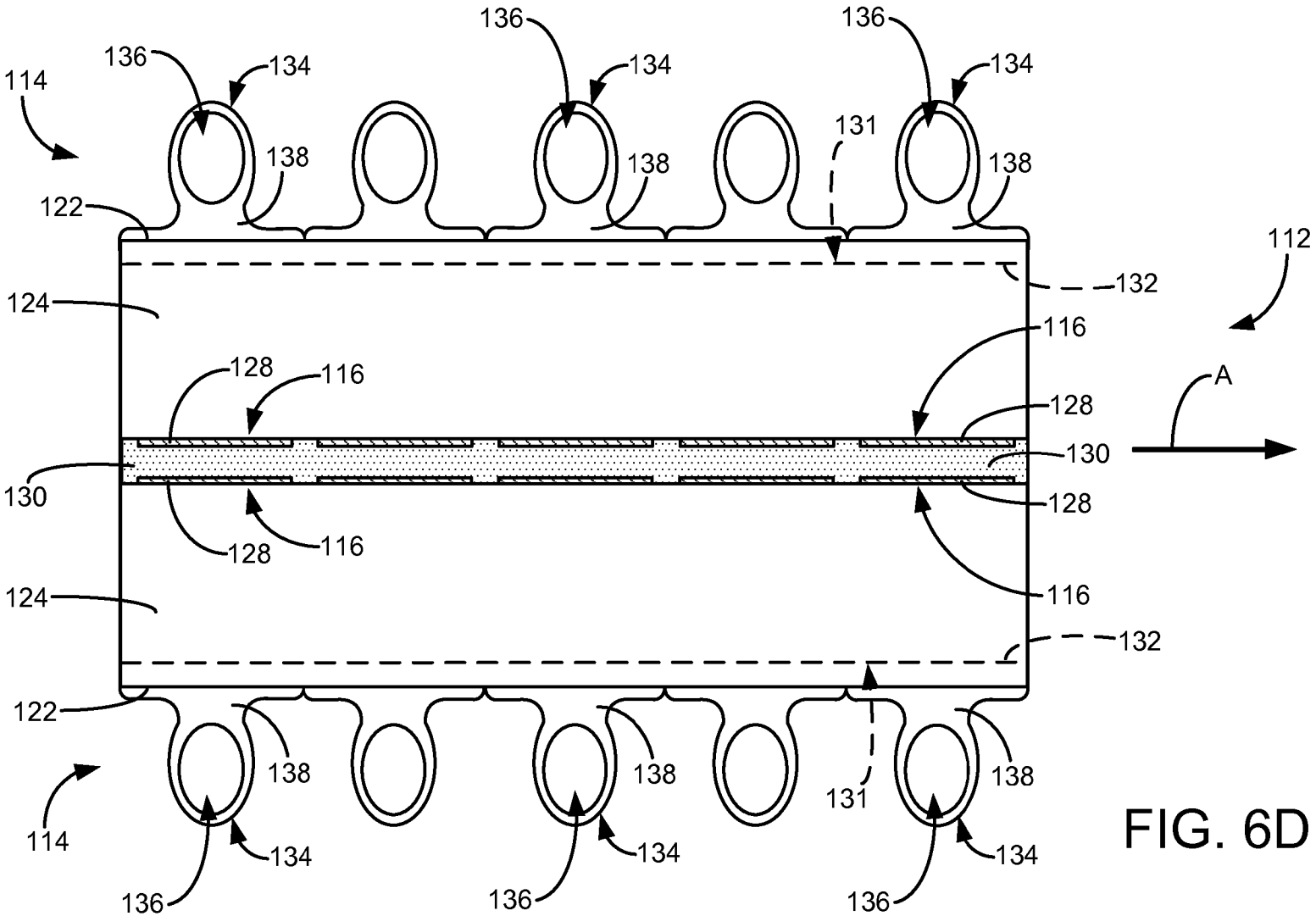

As shown in FIG. 6D, films of elastomer materials (referred to as elastomer films 114) may then be laminated to the rear surface of tag web 112 to form bond zones 131, adjacent to fold lines 122, and ending at bonding zone edges 132 (shown with broken lines in FIG. 6D; see also edge 132 in FIG. 5). Bonding zones 131 correspond to flat bonding segment 32 for multiple foldable tags 10. Elastomer films 114 may then be cut or otherwise shaped to introduce open areas 136 and thus form multiple expandable loops 134, which correspond to expandable loops 34 for the multiple foldable tags 10.

Figure 6E:
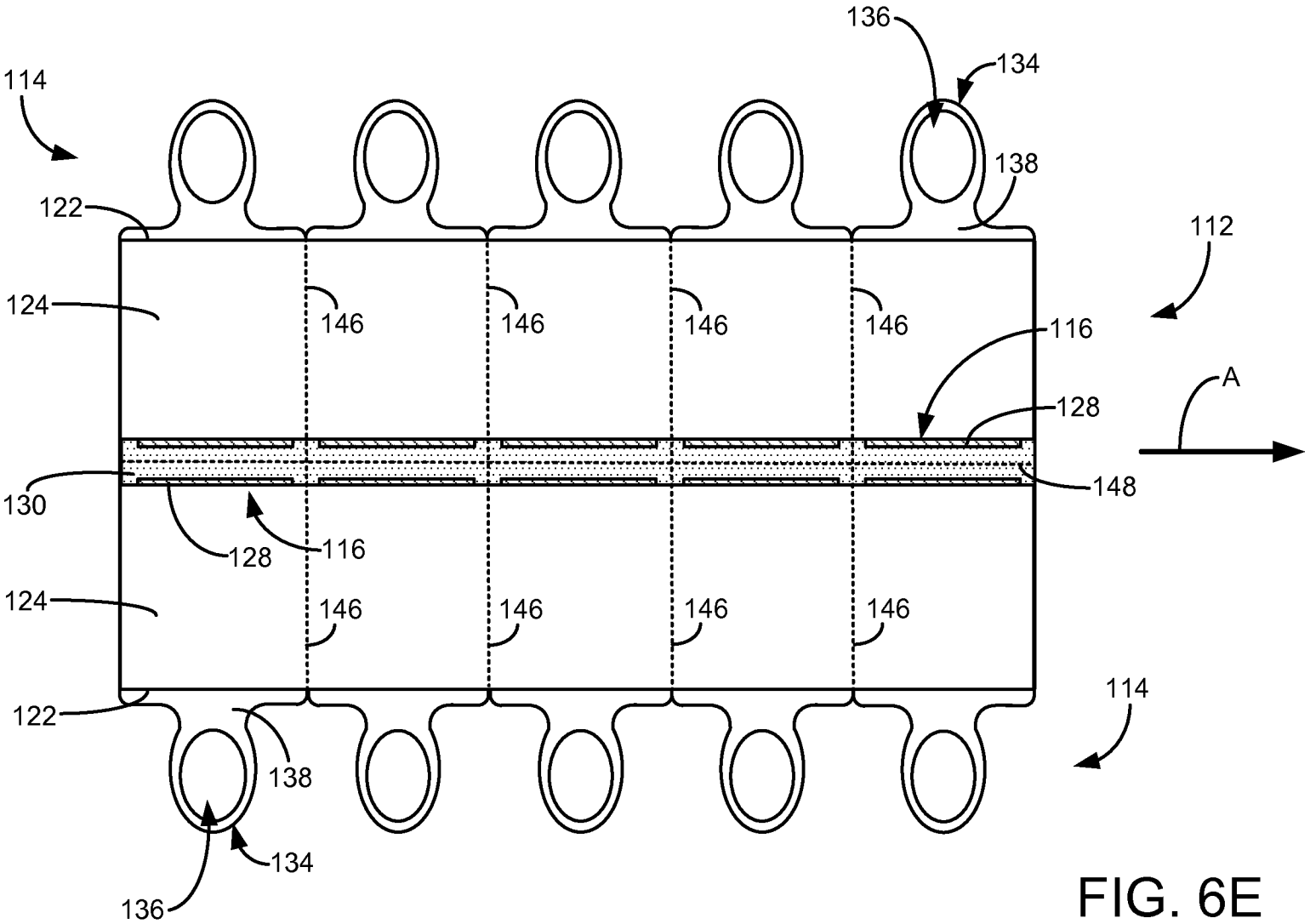

As shown in FIG. 6E, the formed advancing web may then be cut, perforated, or otherwise marked to provide lines of weakness 146 and 148, which may be used to separate the web into individual foldable tags 10. In particular, lines of weakness are formed along sealed regions 130, between pockets 116, thereby dividing a particular sealed region 130 into adjacent sealed borders 30 of adjacent foldable tags 10.

Figure 6F:
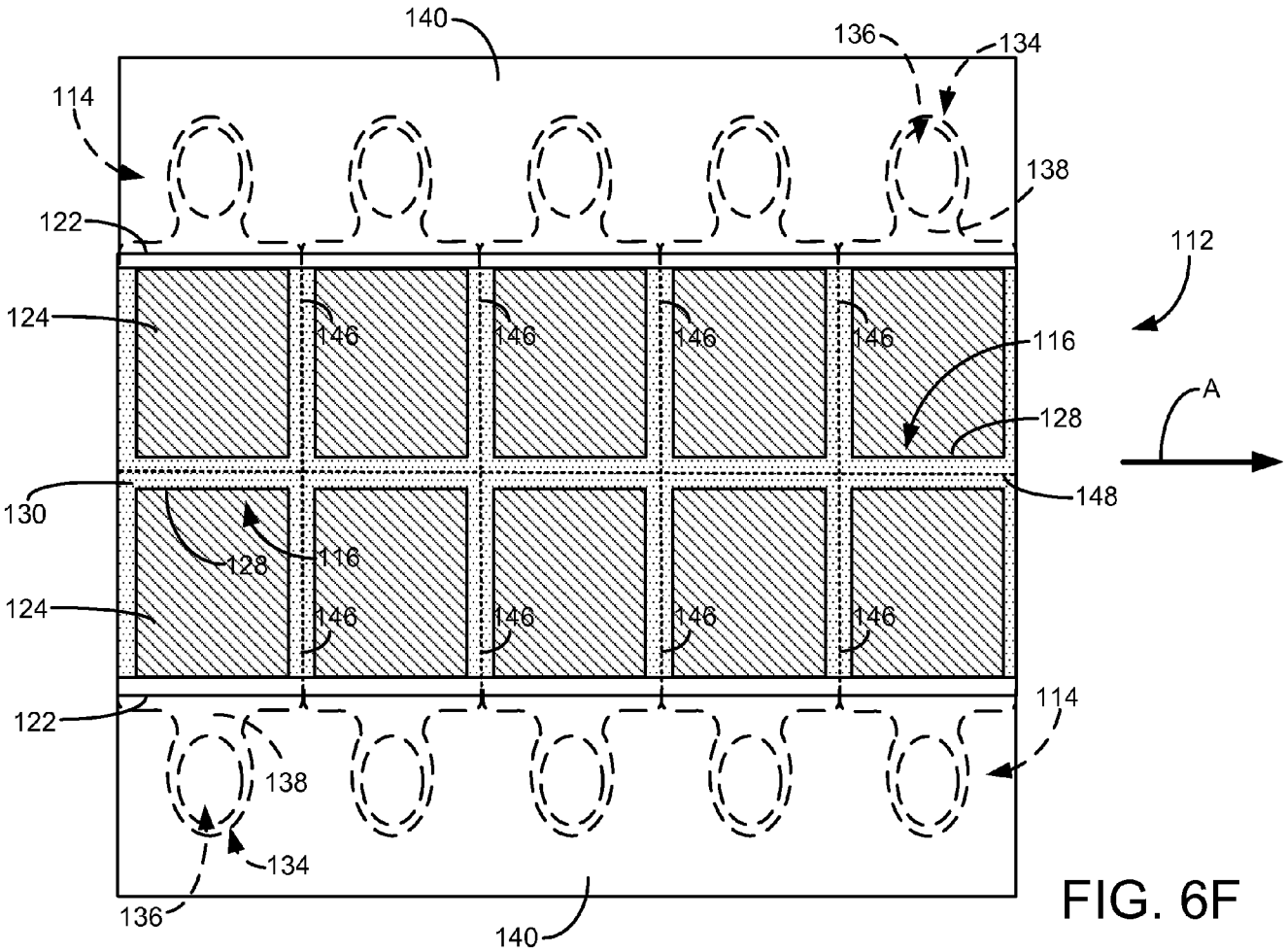

FIG. 6F illustrates an optional step in the manufacturing process, and is suitable for situations in which users (e.g., customers) will insert items into pockets 16 of the multiple foldable tags 10 after the manufacturing process is completed. As shown in FIG. 6F, tag portion 112 may be reopened at fold line 122 prior to completion of the manufacturing process. This opening step may be performed at any point in the process after forming and cutting elastomer films 114 to provide the multiple expandable loops 134.

Reopening web tag 112 in this manner allows the users of the multiple foldable tags 10 to receive them in their opened states. This correspondingly reduces the time required for the users to insert items into the pockets 16 of the multiple foldable tags 10 by eliminating the need for the users to reopen each foldable tag 10.

After the manufacturing process is complete, the individual foldable tags 10 may be separated for individual use, or maintained in sheet or roll form for bulk shipping and subsequent use. Examples of suitable sheet and/or roll forms include those disclosed in King et al., U.S. Pat. No. 7,836,622, Ludlow et al., U.S. Pat. No. 7,281,345, and Ludlow et al., International Application Publication No. WO07/084,119.

Figure 7:
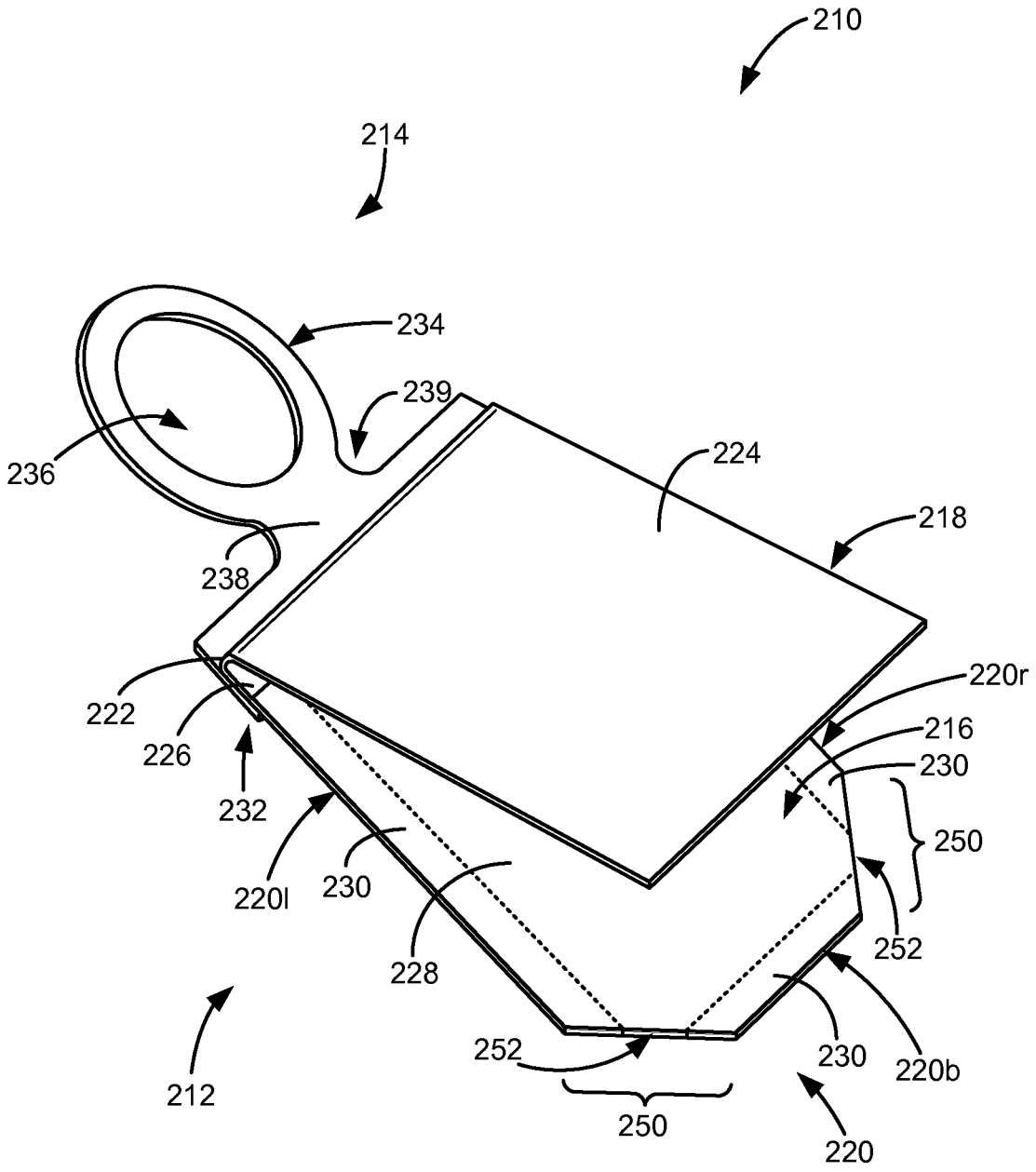
FIG. 7 is a perspective illustration of an alternative foldable tag of the present disclosure having an expandable loop and a pocket with section cuts, where the foldable tag is in a partially-opened state.

FIGS. 7-12B illustrate foldable tag 210, which is an example of an alternative foldable tag of the present disclosure. As shown in FIG. 7, foldable tag 210 functions in a similar manner to foldable tag 10, where the reference numbers of the corresponding components are increased by "200". In this embodiment, foldable tag 210 includes cut sections 250 at the bottom end of film 228 and rear segment 220. Each cut section 250 extends from a lateral side of film 228 and rear segment 220 to the bottom end of film 228 and rear segment 220. This defines slit openings 252 into pocket 216 between adjacent sealed borders 230, at locations that are offset from inlet opening 244 of pocket 216. As discussed below, slit openings 252 allow pocket 216 to neatly expand to retain larger items, such as sample bottles and the like.

Figure 8:
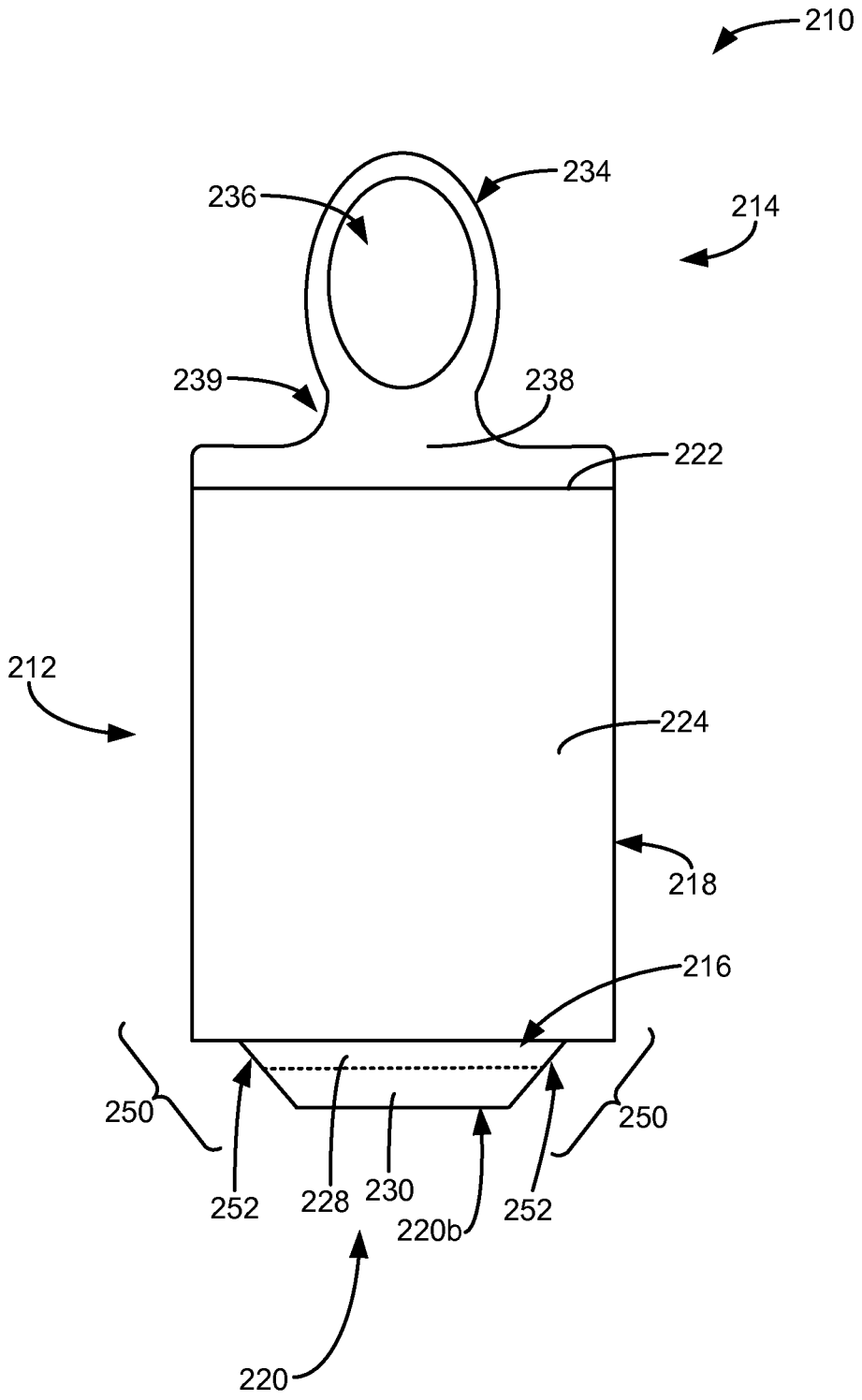
FIG. 8 is a front view of the alternative foldable tag in a closed state.
Figure 9:
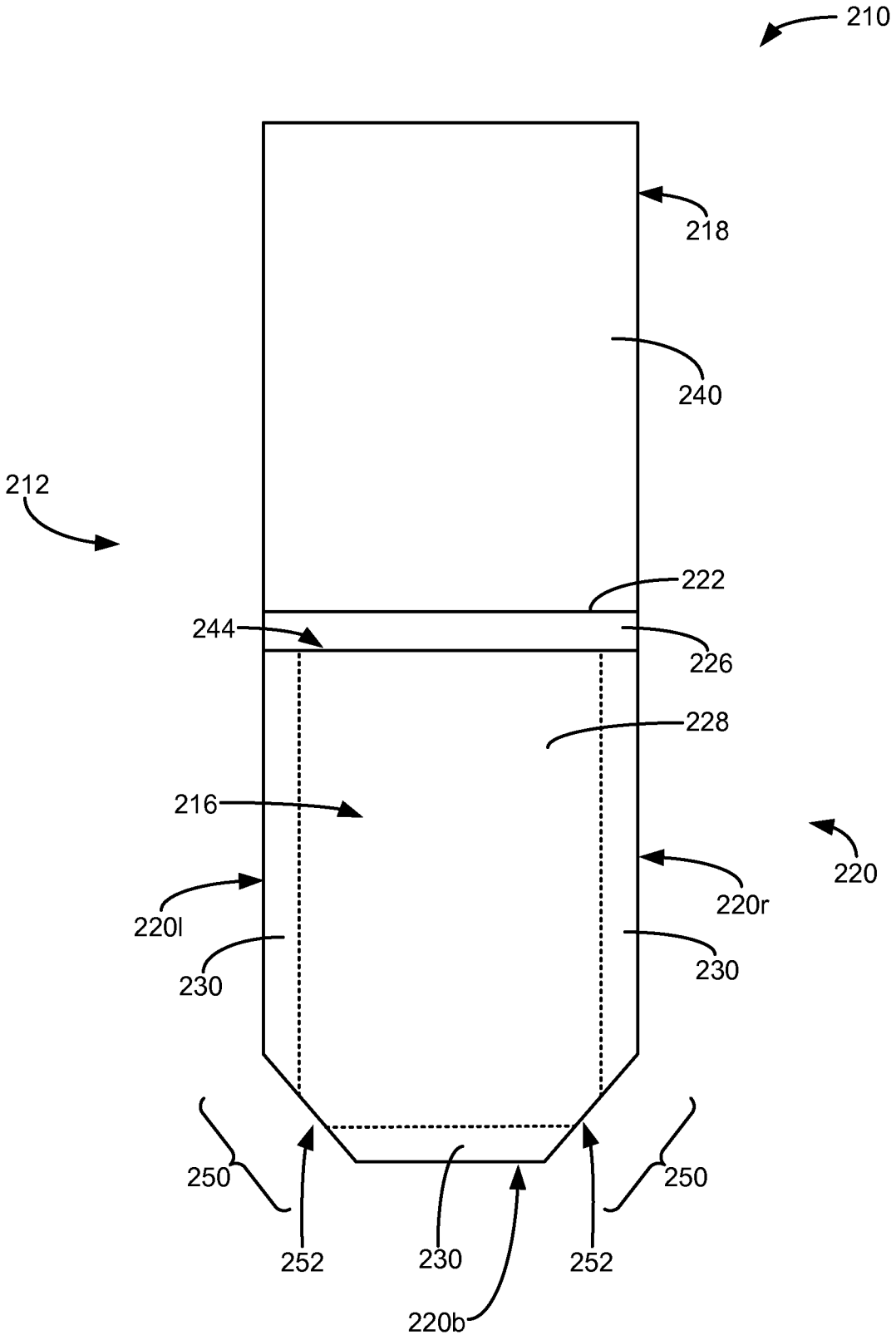
FIG. 9 is a front view of the alternative foldable tag in a fully-opened state.
Figure 10:
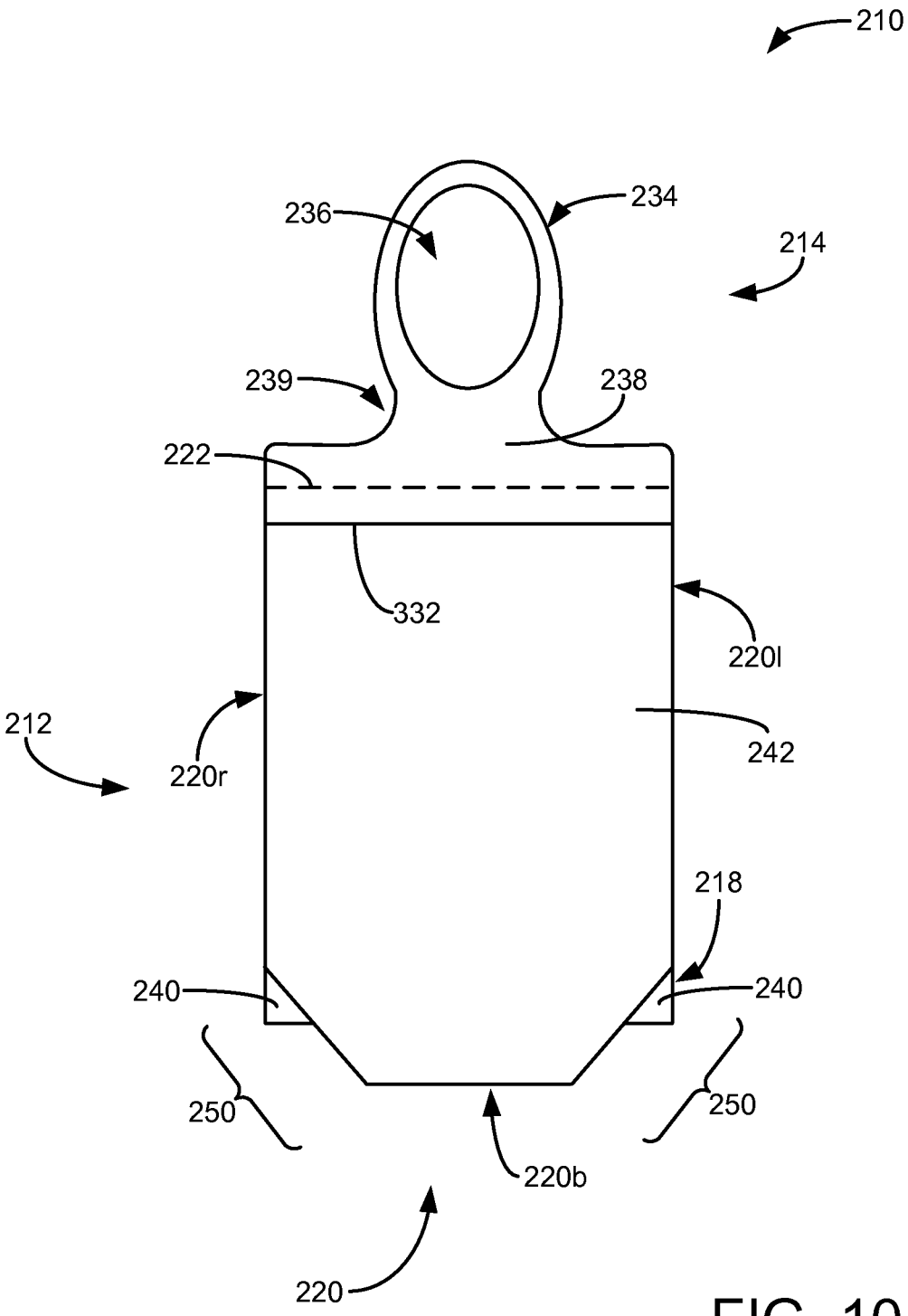
FIG. 10 is a rear view of the alternative foldable tag in the closed state.

As shown in FIGS. 8-10, cut sections 250 may extend beyond the length of front segment 18. Cut sections 250 are desirably shaped to provide slit openings 252 with suitable sizes for expansion, while also reducing the risk of delamination by sealed borders 230. As such, suitable sizes for slit openings 252 may vary depending on the dimensions of rear segment 220 and sealed borders 230. Sealed borders 230 accordingly extend along at least a portion of bottom edge 220*b*, along at least a portion of left edge 230*l*, and along at least a portion of right edge 230*r*. Additionally, in the shown embodiment, cut sections 250 and slit openings 252 do not extend through front segment 218, allowing front segment 218 to maintain its original rectangular geometry, for example.

Figure 11A:
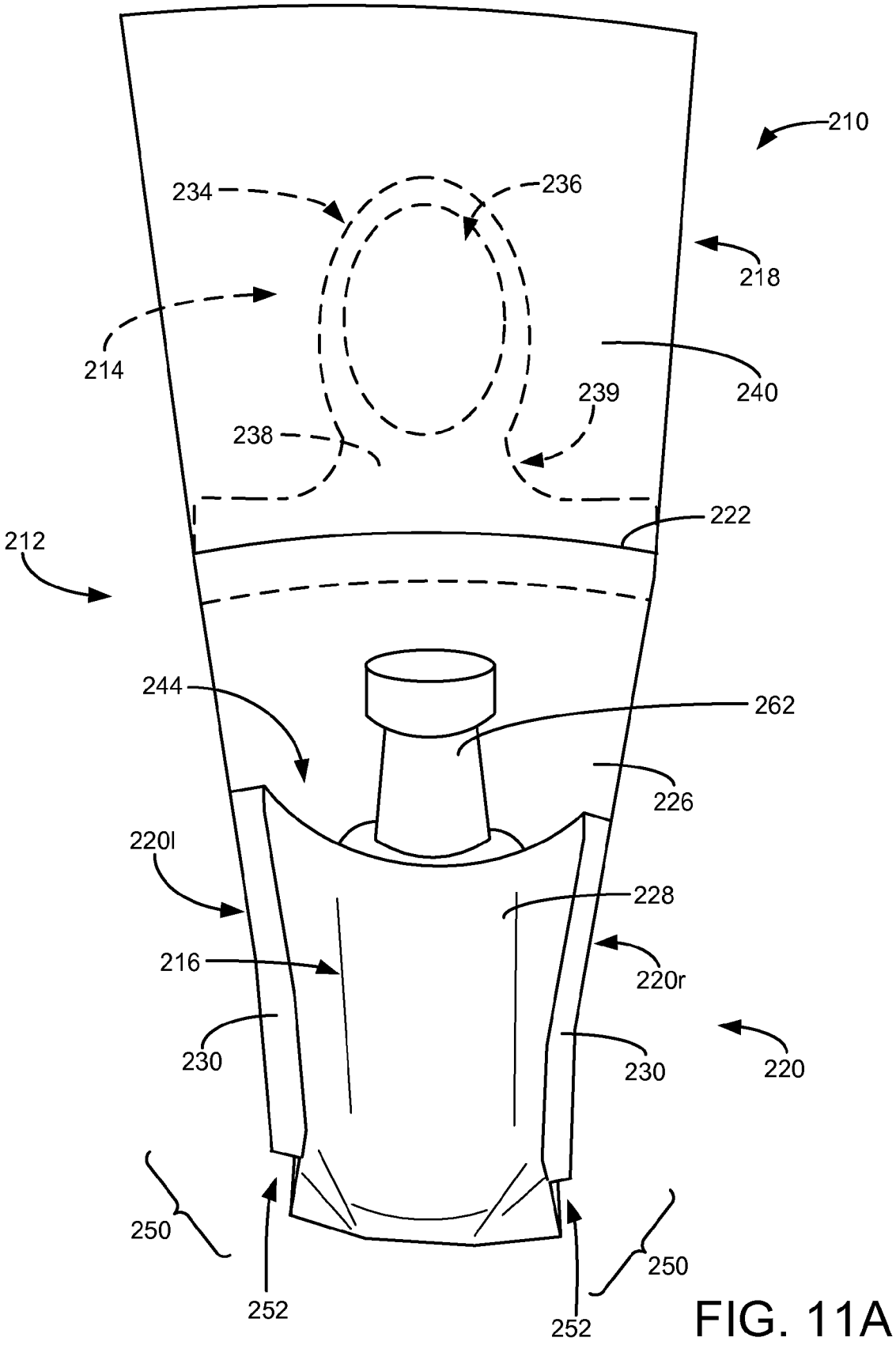
FIG. 11A is a front top perspective view of the alternative foldable tag in the fully-opened state and retaining a sample bottle.
Figure 11B:
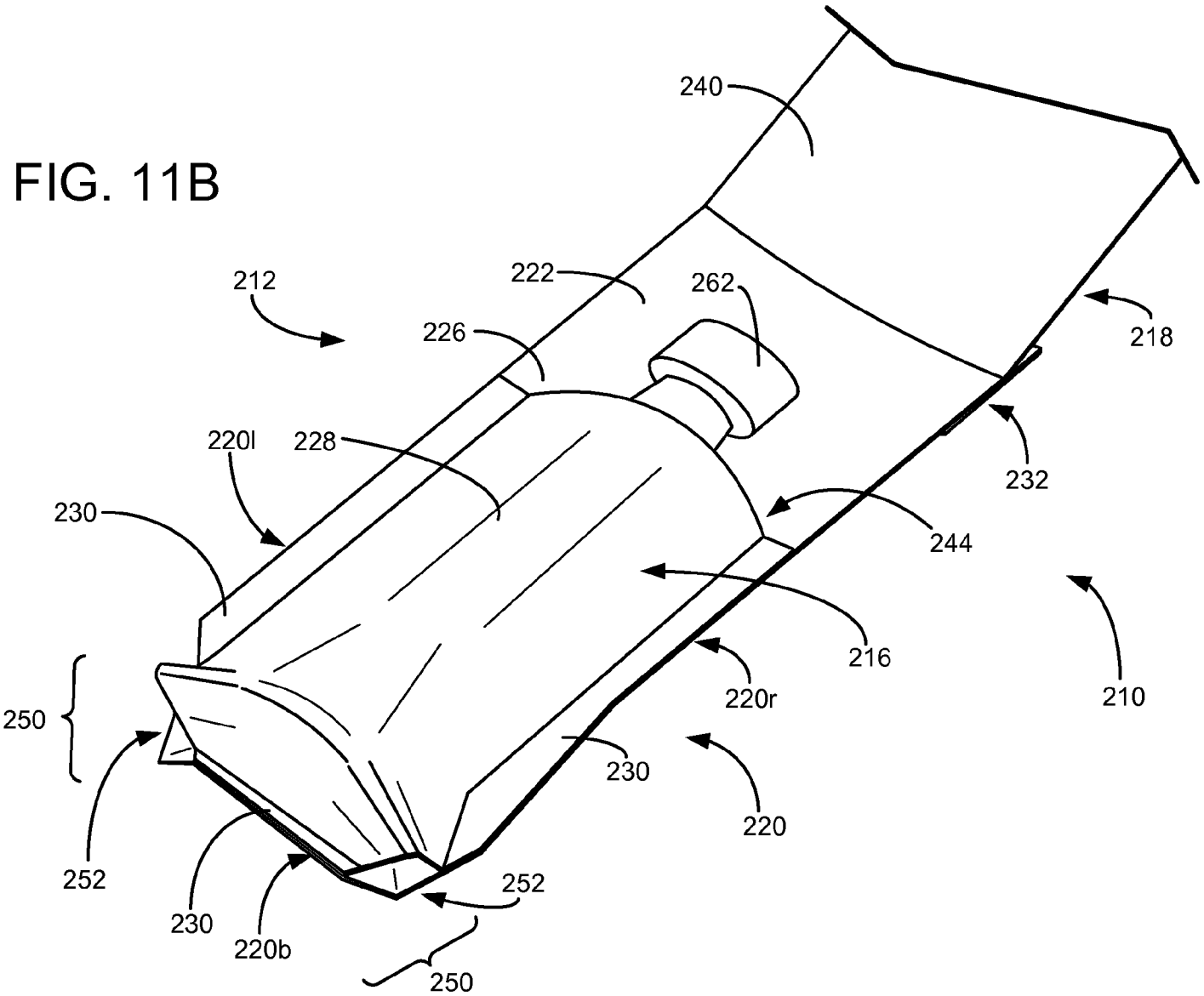
FIG. 11B is a front side perspective view of the alternative foldable tag in the fully-opened state and retaining the sample bottle, where the expandable loop is hidden from view.

As shown in FIGS. 11A and 11B, to insert an item into pocket 216 (e.g., sample bottle 262), a user may unfold front segment 218 from rear segment 220 to provide access to pocket 216 via inlet opening 244. The user may then open pocket 216 by flexing rear segment 220 and film 228. This expands pocket 216 with neat fold lines due to slit openings 252, where rear segment 220 separates from film 228 at slit openings 252 (as best shown in FIG. 11B) to expand the dimensions of pocket 216. This embodiment is particularly suitable when tag portion 12 is produced from a rigid material that resists deformation when a larger item, such as sample bottle 262, is inserted into pocket 216. Instead, film 228 may deform to a greater extent due to the expansion at slit openings 252 to accommodate the larger item. Accordingly, foldable tag 210 may retain larger items while maintaining good adhesion between rear segment 220 and film 228 at sealed borders 230. While illustrated as being opaque in FIGS. 11 and 12, film 228 may also be a translucent or transparent polymeric film, which may be biodegradable, degradable, and/or recyclable.

Figure 12A:
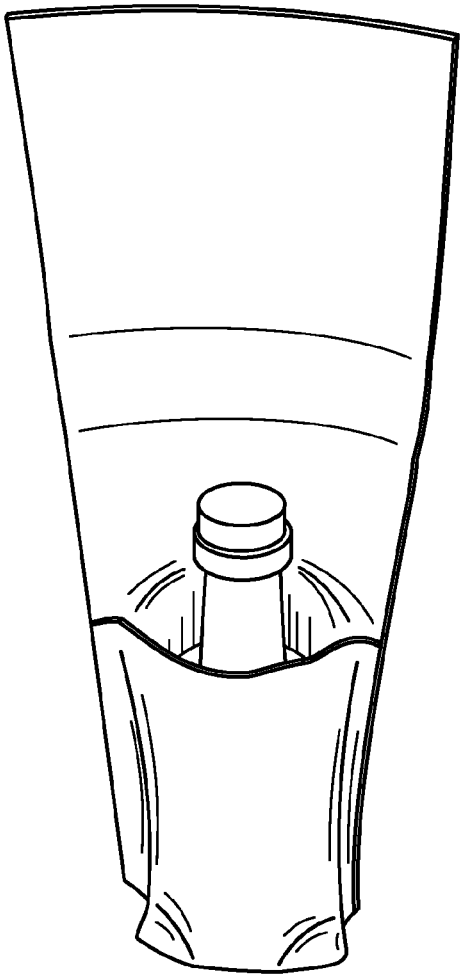
FIG. 12A is a front top perspective view photograph of the alternative foldable tag in the fully-opened state and retaining a sample bottle, where the expandable loop is hidden from view.
Figure 12B:
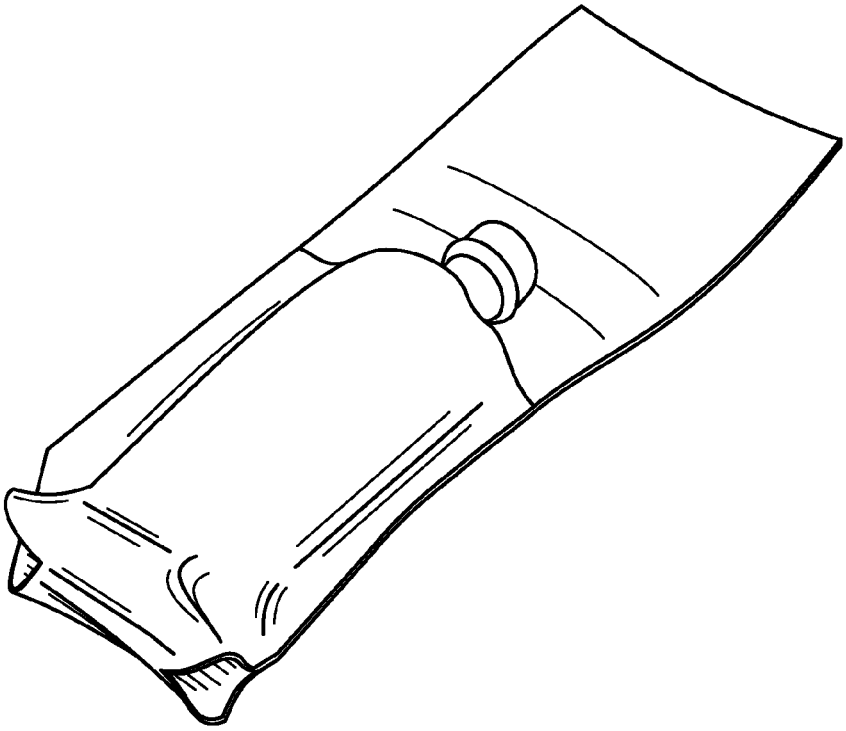
FIG. 12B is a front side perspective view photograph of the alternative foldable tag in the fully-opened state and retaining the sample bottle, where the expandable loop is hidden from view.

FIGS. 12A and 12B are photographs of an example of foldable tag 210 in use with a bottle, and respectively correspond to the view shown in FIGS. 11A and 11B. As shown in FIG. 12A, as the pocket is expanded, the slit openings deform the film and the rear segment of the tag portion at the base edge. As shown in FIG. 12B, when the bottle is fully inserted, the deformed base edge is fully expanded to a point that is greater than is otherwise achievable if the film was bonded to the rear segment of the tag portion at the base corners. The slit openings accordingly provide a freedom of expansion that can accommodate items of various sizes and geometries.

Foldable tag 210 may also be manufactured using a variety of different techniques. FIGS. 13A-13G illustrate a method for manufacturing and using multiple foldable tags 210 using a web-based process, which is similar to the method illustrated above in FIGS. 6A-6F. In the example shown in FIGS. 13A-13G, the multiple foldable tags 210 are manufactured in two opposing rows, which increases production volume. In an alternative embodiment, the multiple foldable tags 210 may be manufactured in a single row.

Figure 13A:
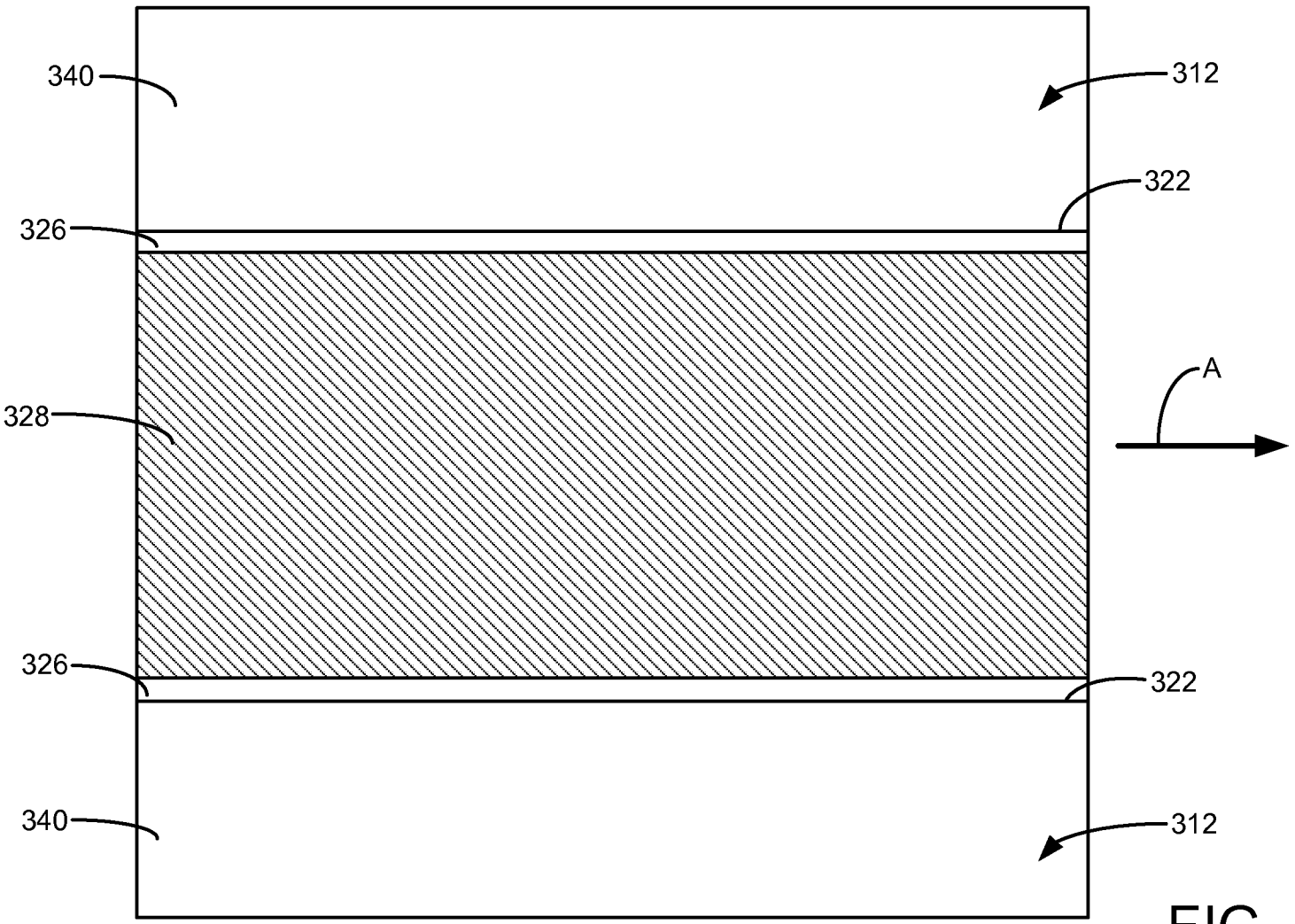
FIGS. 13A-13G are schematic illustrations of a web-based process for manufacturing and using multiple foldable tags of the present disclosure.
Figure 13B:
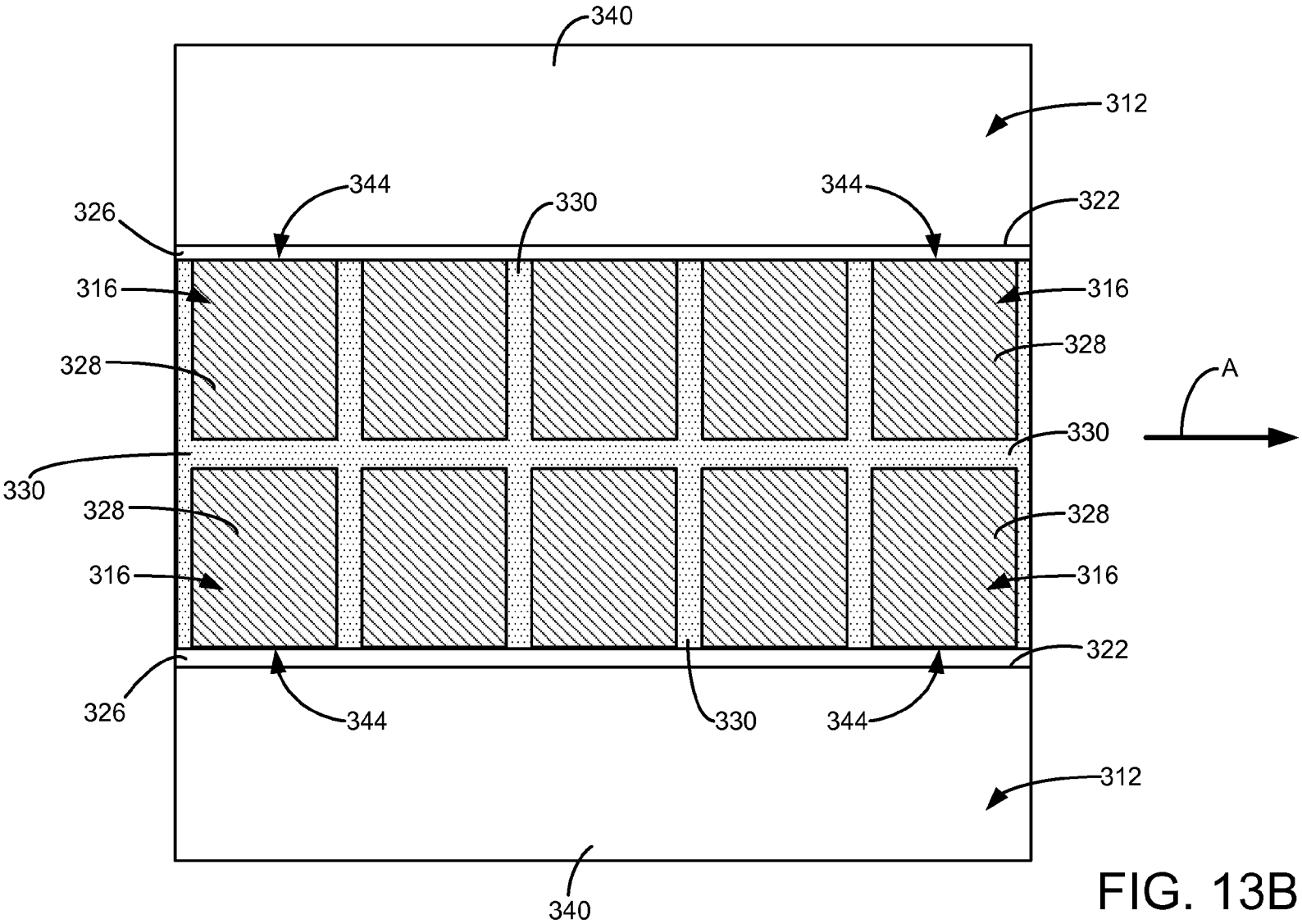

The steps illustrated in FIGS. 13A and 13B are the same as illustrated above in FIGS. 6A and 6B. As shown in FIG. 13A, the process may initially involve advancing a web of a material for tag portion 212 (referred to as tag web 312) in the direction of arrow A. In the shown example, tag web 312 includes fold lines 322, which correspond to the fold lines 222 for the multiple foldable tags 210. Furthermore, the shown surface of tag web 312 includes surface regions 326 and 340, which respectively correspond to front surface 226 and rear surface 240 of tag portion 212. A sheet of material for film 228 of pocket 216 (referred to as pocket film 328) may be laminated over a central portion of tag web 312.

As shown in FIG. 13B, various portions of pocket film 328 may be sealed against tag web 312 to form sealed regions 330 that correspond to sealed borders 230 of foldable tag 210. In one embodiment, sealed regions 330 are formed by heat sealing pocket film 328 to tag web 312 at the shown locations, such as with a heated annular die roller or a heated die press. The extent of the heat sealing may vary depending on the materials used for tag web 312 and pocket film 328. However, the heat sealing desirably provides a good heat seal bond at seal regions 330 that prevent delamination under normal conditions of use. In alternative embodiments, tie layers may be used to provide adhesive bonding in addition to, or as an alternative to heat sealing. In further alternative embodiments, other suitable sealing techniques, such as ultrasonic sealing, may be used. In one embodiment, the heating sealing step shown in FIG. 13B may be performed at the same time, or at substantially the same time, as the lamination of pocket film 328 over tab web 312.

Heat sealing pocket film 328 in this manner creates multiple pockets in the advancing web (referred to as pockets 316), which correspond to pockets 216 for multiple foldable tags 210. As further shown, sealed regions 330 extend only around the lateral sides and bottom of each pocket 316, providing an inlet opening 344 for each pocket 316. While pockets 316 are illustrated as being rectangular in shape, in alternative embodiments, the healing sealing may define pockets 316 with a variety of different geometries.

If desired, one or more items may also be inserted into the formed pockets 316 at this point in the manufacturing process. For example, coupons or product samples may be inserted into pockets 316 as the advancing web moves in the direction of arrow A. To accommodate the line speed of the advancing web, the insertion step is desirably performed in an automated manner. However, the one or more items may alternatively be manually inserted into pockets 316. Alternatively, users (e.g., customers) may insert items into pockets 216 of the multiple foldable tags 210 after the manufacturing process is completed.

Figure 13C:
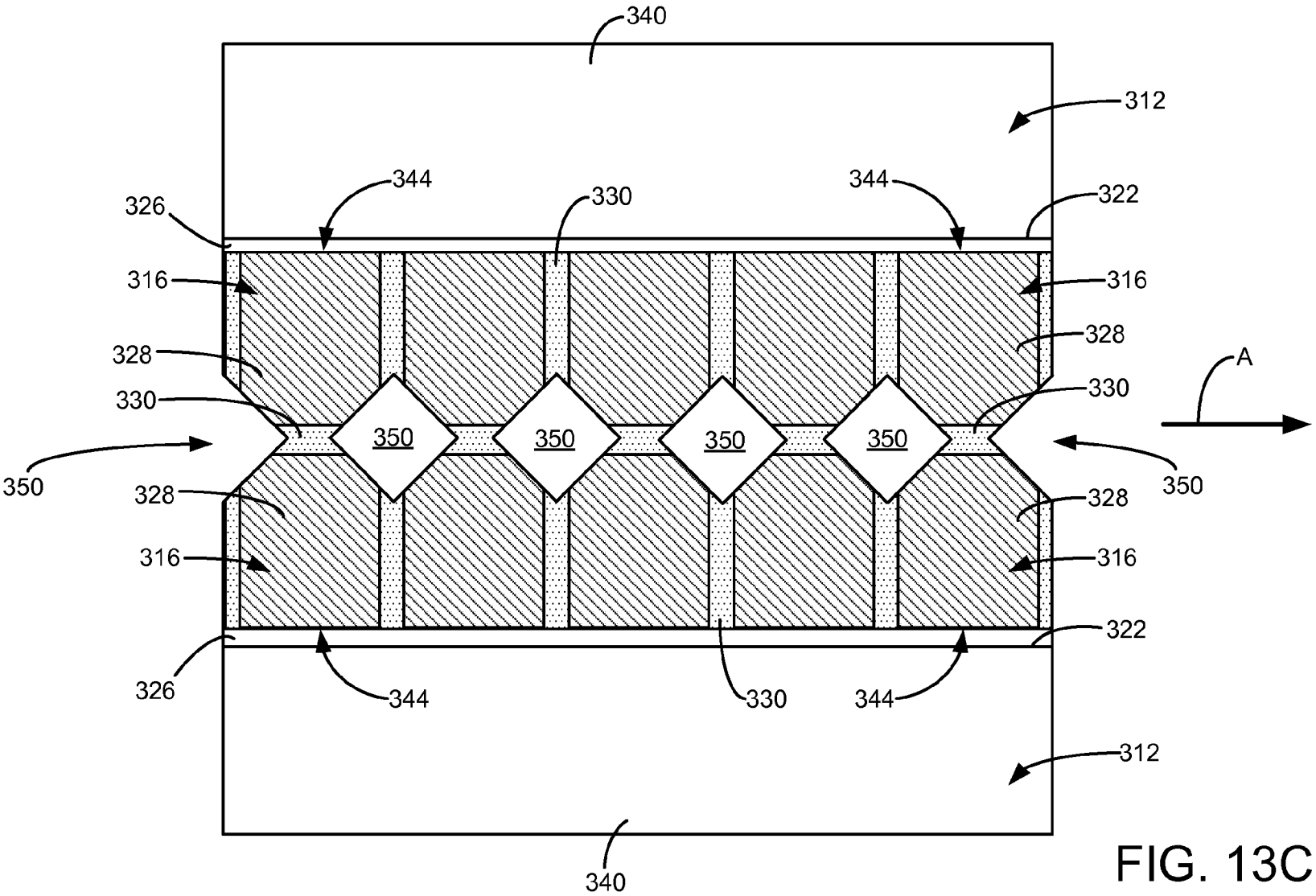

As shown in FIG. 13C, prior to folding tag web 312 at fold lines 322, section holes 350 are cut into tag web 312 and pocket film 328 in registered alignment with the locations of sealed regions 330, as shown. Section holes 350 may be formed with a roller cutter or similar cutting tool, and define cut sections 250 and slit openings 252 (shown in FIGS. 7-12) for each foldable tag 210. In the shown example, each section hole 350 has a diamond geometry that forms the angled shapes of cut sections 250 for each foldable tag 210.

Figure 13D:
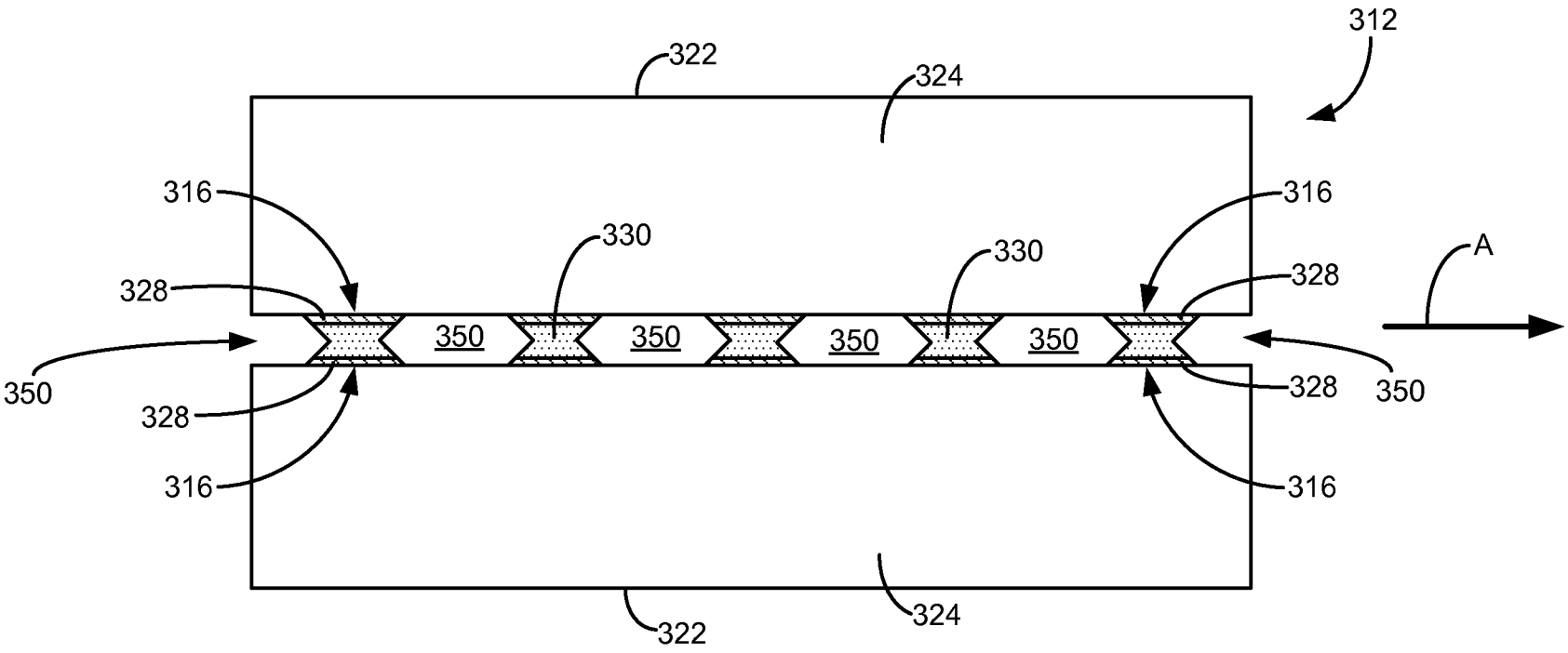

As shown in FIG. 13D, tag web 312 may then be folded at fold lines 322, such that surface region 340 is folded closed against pockets 316. As such, surface regions 324, corresponding to front surface 224 of foldable tag 210, are shown. As further shown, because section holes 350 were cut prior to folding tag web 312, the front segment of tag web 312 that contains surface region 324 and surface region 340 (shown in FIGS. 13A-13C), and corresponding to front segments 218 of the multiple foldable tags 210, extends over section holes 350 and is free of cut sections corresponding to cut sections 250. In other words, section holes 350 do not extend through front segments 218.

Figure 13E:
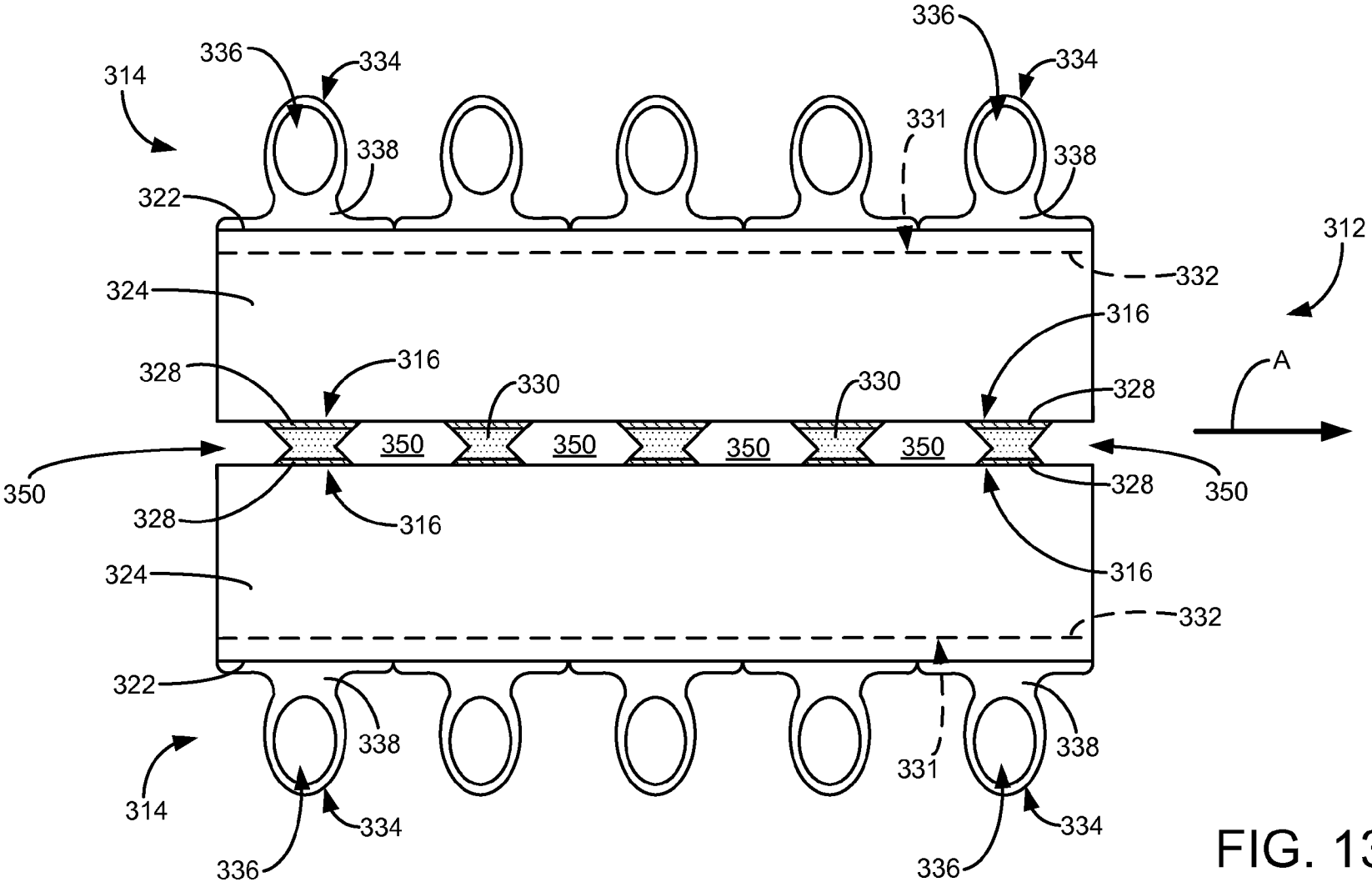

As shown in FIG. 13E, films of elastomer materials (referred to as elastomer films 314) may then be laminated to the rear surface of tag web 312 to form bond zones 331, ending at bonding zone edges 332 (shown with broken lines in FIG. 13E; see also edge 332 in FIG. 10). Bonding zones 331 correspond to flat bonding segment 232 for multiple foldable tags 210. Elastomer films 314 may then be cut or otherwise shaped to introduce open areas 336 and thus form multiple expandable loops 334, which correspond to expandable loops 234 for the multiple foldable tags 210.

Figure 13F:
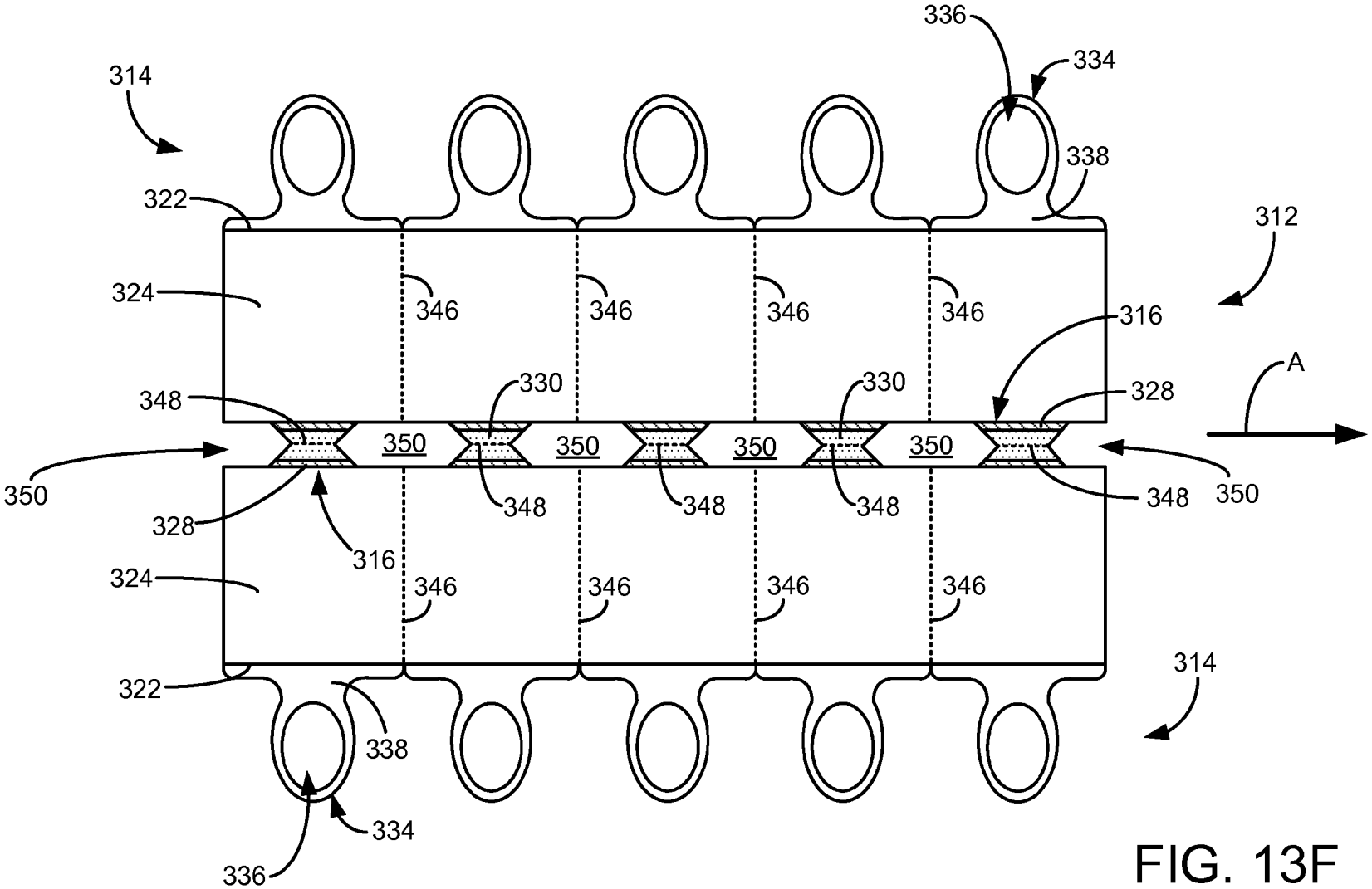

As shown in FIG. 13F, the formed advancing web may then be cut, perforated, or otherwise marked to provide lines of weakness 346 and 348, which may be used to separate the web into individual foldable tags 210, each having a pocket 316 and an expandable loop 334. In particular, lines of weakness are formed along sealed regions 330, between pockets 316, thereby dividing a particular sealed region 330 into adjacent sealed borders 230 of adjacent foldable tags 210. In the shown embodiment, lines of weakness 346 and 348 are desirably in registration with the diamond-shape vertices of section holes 350 to provide the angled geometries of cut sections 250 (shown in FIGS. 7-12) for each of the multiple foldable tags 210. In other words, lines of weakness 346 and 248 are substantially aligned with the diamond-shape vertices of section holes 350.

In an optional embodiment, as discussed above for foldable tags 10 (as shown in FIG. 6F), tag portion 312 may be reopened at fold line 322 prior to completion of the manufacturing process. This opening step may be performed at any point in the process after forming and cutting elastomer films 314 to provide the multiple expandable loops 334. Reopening web tag 312 in this manner allows the users of the multiple foldable tags 210 to receive them in their opened states. This correspondingly reduces the time required for the users to insert items into the pockets 216 of the multiple foldable tags 210 by eliminating the need for the users to reopen each foldable tag 210.

Figure 13G:
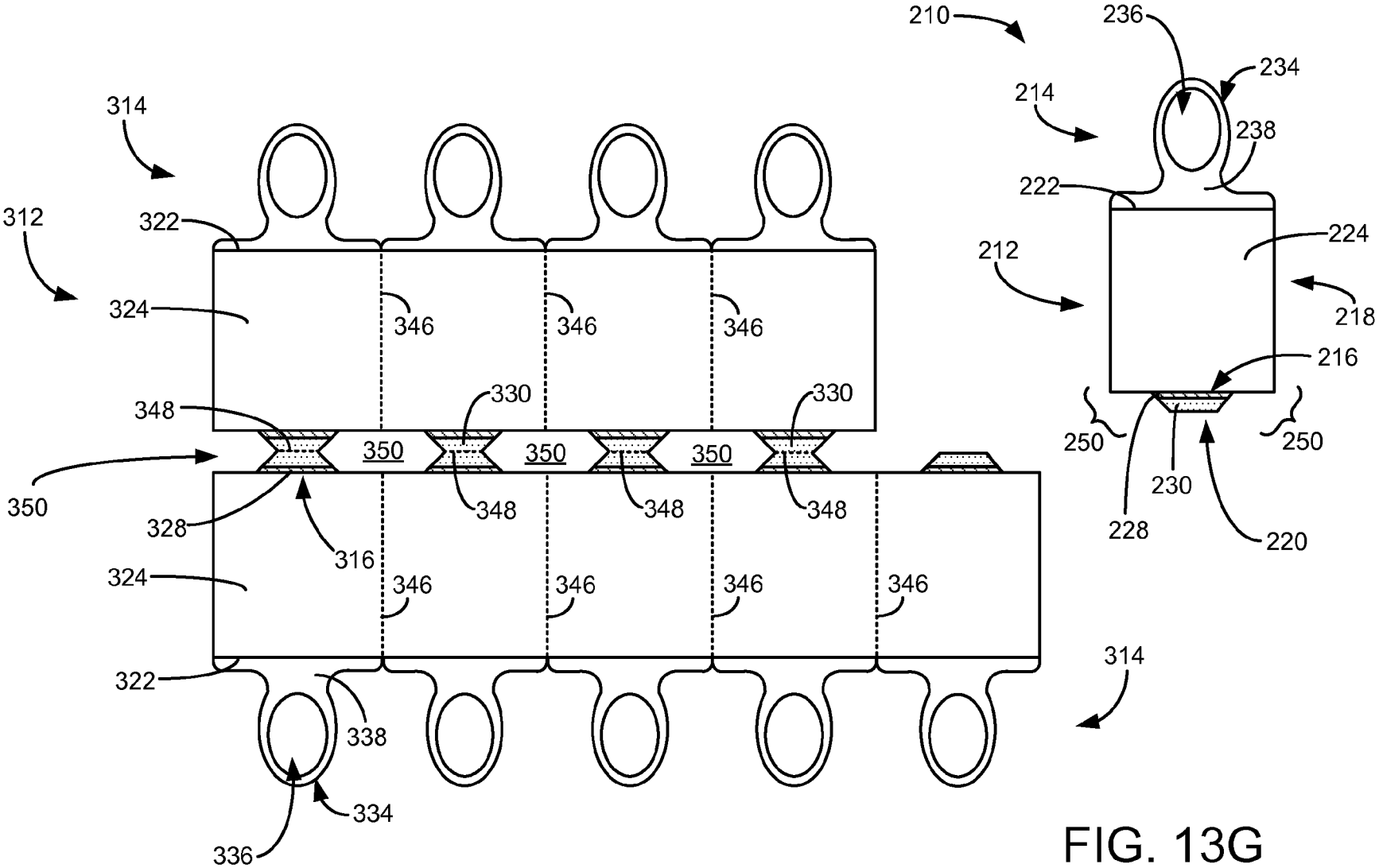

After the manufacturing process is complete, the individual foldable tags 210 may be separated for individual use (as shown in FIG. 13G), or maintained in sheet or roll form for bulk shipping and subsequent use. Examples of suitable sheet and/or roll forms include those disclosed in King et al., U.S. Pat. No. 7,836,622, Ludlow et al., U.S. Pat. No. 7,281,345, and Ludlow et al., International Application Publication No. WO07/084,119. Upon separation, front segment 218 may be unfolded from rear segment 220, and one or more items may be inserted into pocket 216 of the unfolded tag 210.

Figure 14:
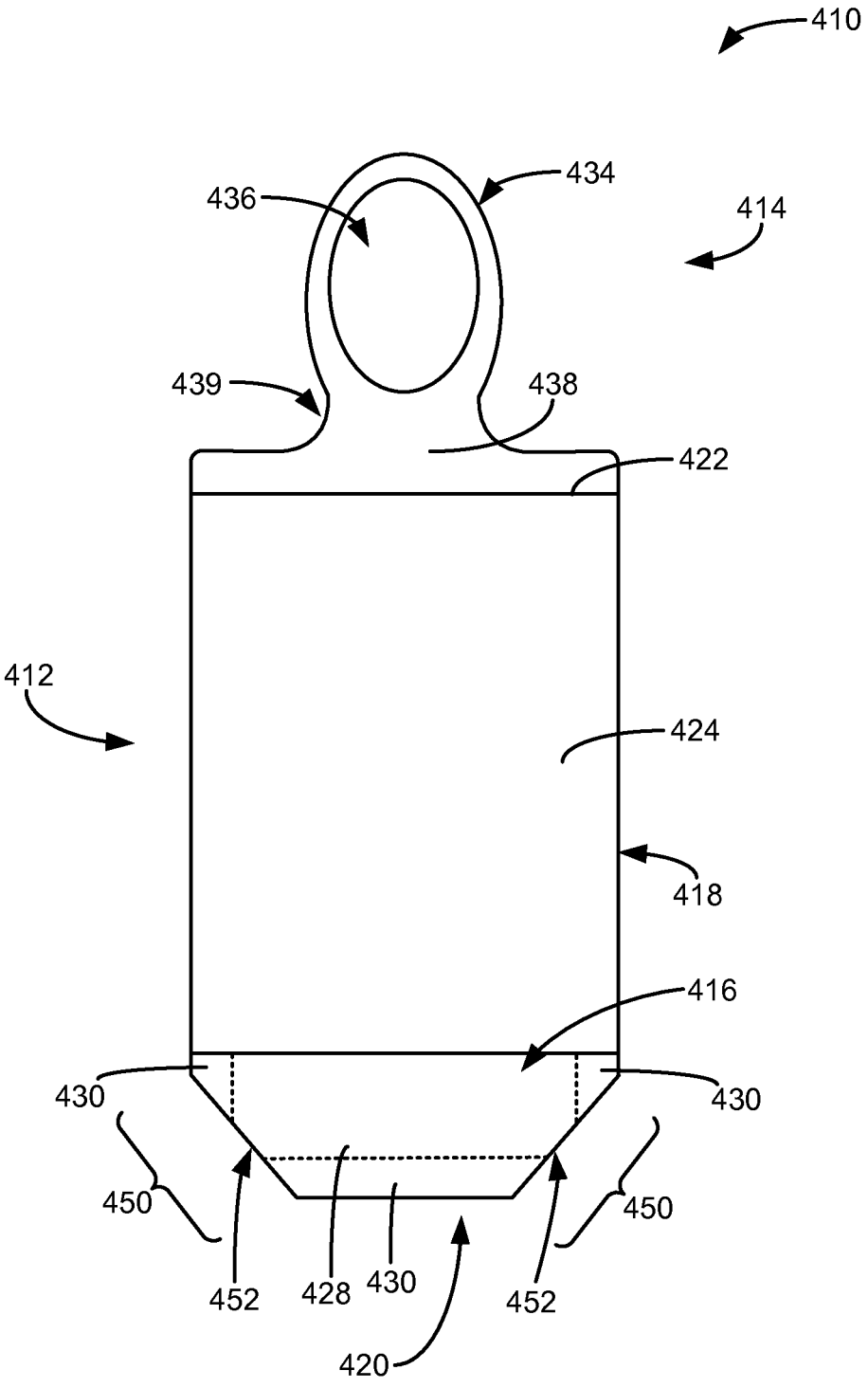
FIG. 14 is a front view of a second alternative foldable tag of the present disclosure having an expandable loop and a pocket with section cuts, where the foldable tag is in a closed state.

FIG. 14 illustrates foldable tag 410, which is an example of a second alternative foldable tag of the present disclosure. As shown in FIG. 14, foldable tag 410 functions in the same manner to foldable tag 210 (shown in FIGS. 7-12), where the reference numbers of the corresponding components are increased by "200" from foldable tag 210 (and by "400" from foldable tag 10, shown in FIGS. 1-5). In this embodiment, the bottom end of rear segment 420 extends further beyond the bottom end of front segment 418, such that cut sections 450 are fully visible when foldable tag 410 is in the closed state, as shown. Cut sections 450 may function in the same manner as cut sections 250 of foldable tag 210, and define slits 452 between adjacent sealed borders 430, which allow pocket 416 to neatly expand to retain larger items, such as sample bottles and the like.

Foldable tag 410 may be manufactured using the same process discussed above for foldable tag 210 with tag web 312 (shown in FIGS. 13A-13G). However, because cut sections 450 are located below front segment 418, section holes corresponding to section holes 350 may be cut into the tag web and pocket film (corresponding to tag web 312 and pocket film 328) before or after folding the tag web at the fold lines. In other words, the steps shown in FIGS. 13C and 13D may be performed in either order since the formed cut sections 450 are outside of the perimeter of front segment 418.

Figure 15:
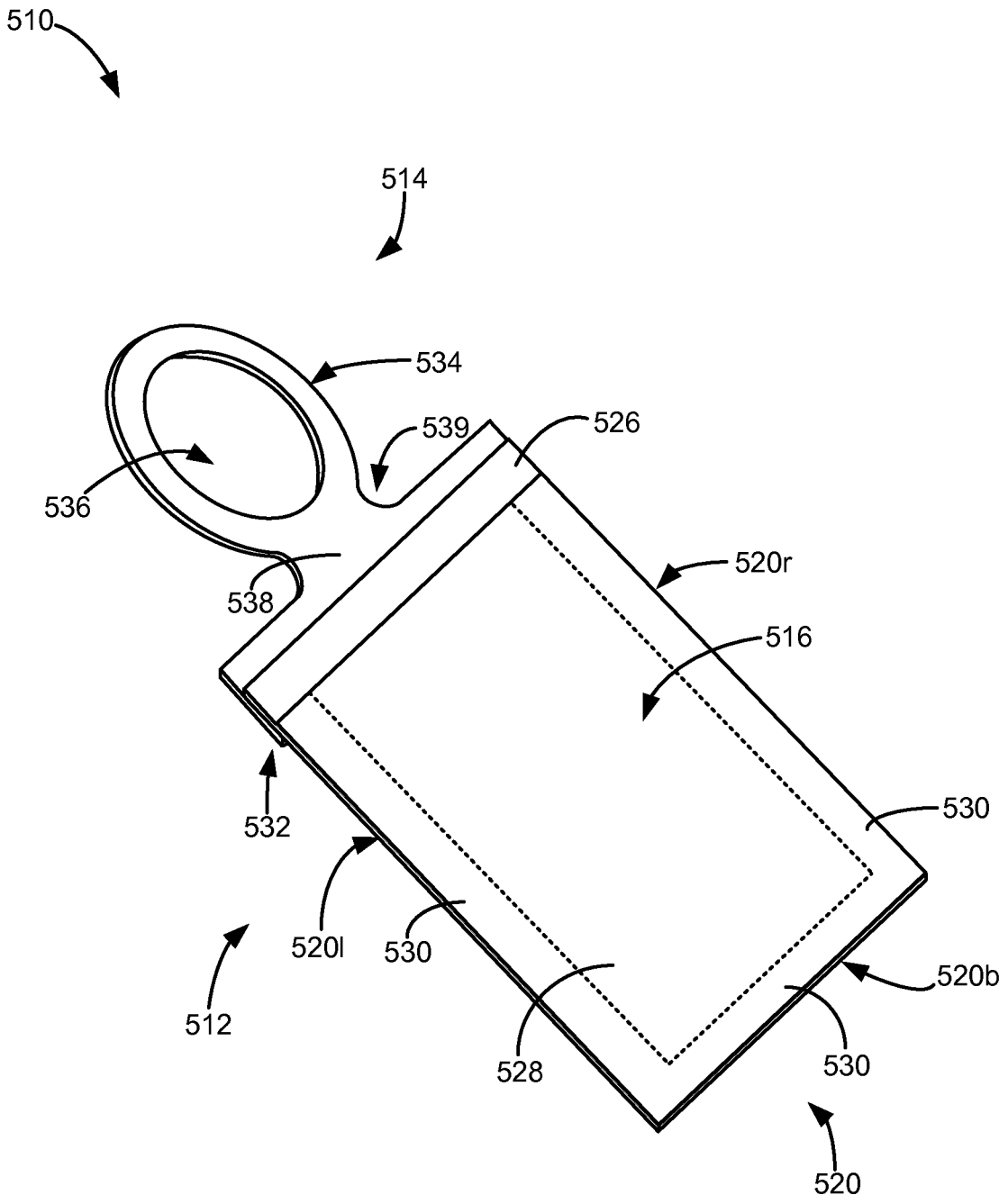
FIG. 15 is a perspective illustration of a third alternative tag of the present disclosure having an expandable loop and a pocket, and with a non-foldable tag.
Figure 16:
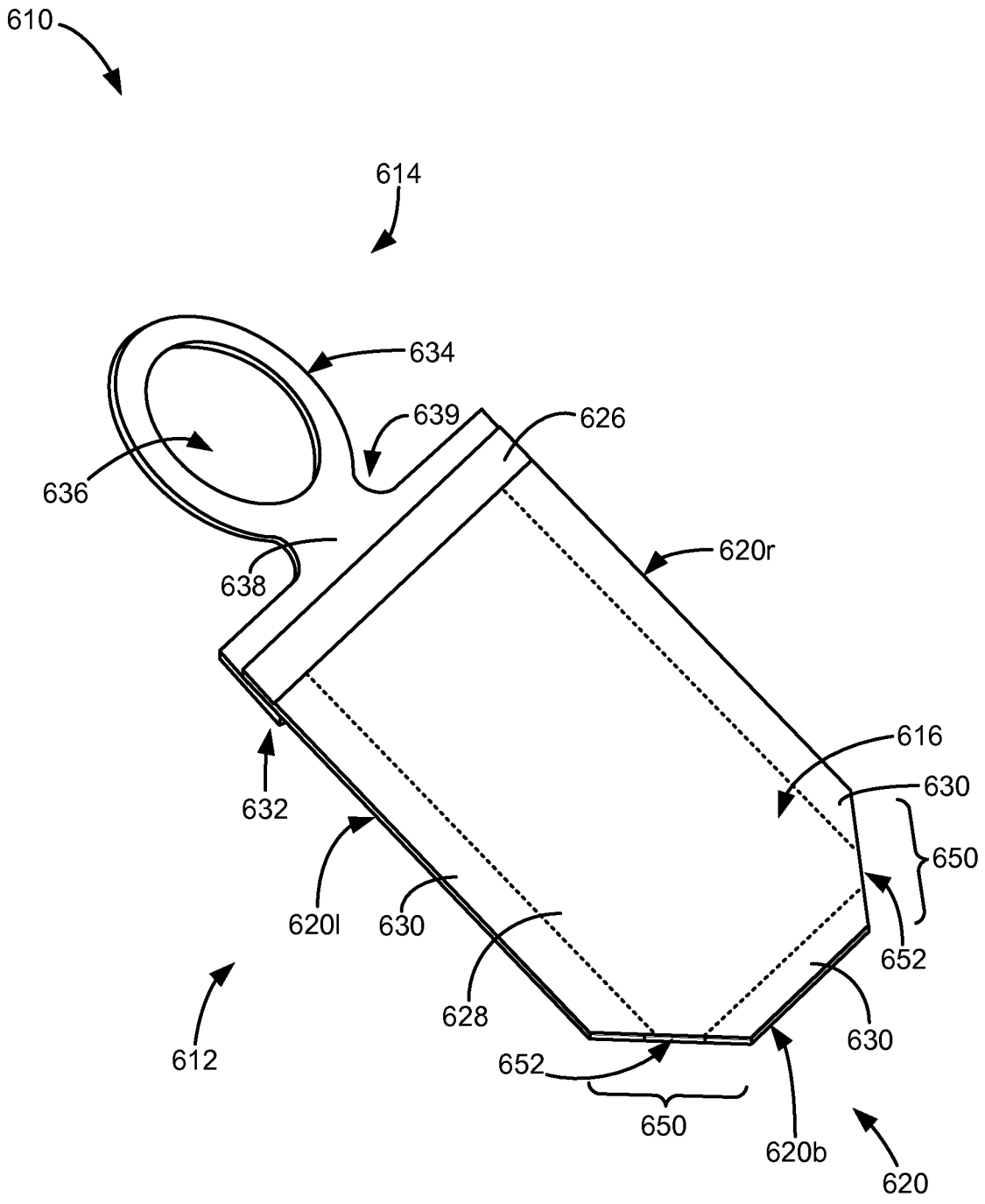
FIG. 16 is a perspective illustration of a fourth alternative tag of the present disclosure having an expandable loop and a pocket with section cuts, and with a non-foldable tag.

FIGS. 15 and 16 illustrate additional alternative tags of the present disclosure, which are similar to tags 10 and 210, but do not include foldable tag portions. As shown in FIG. 15, tag 510 is a non-foldable tag similar to foldable tag 10 (shown in FIGS. 1-5), where the reference numbers of the corresponding components are increased by "500" from foldable tag 10. In this embodiment, tag 510 does not include a front segment corresponding to front segment 18 of tag 10. Instead, tag 510 only includes rear segment 520 with pocket 516. As such, tag 510 may prominently display items retained in pocket 516 (e.g., when film 528 is transparent).

As shown in FIG. 16, tag 610 is a non-foldable tag similar to foldable tag 210 (shown in FIGS. 7-12), where the reference numbers of the corresponding components are increased by "400" from foldable tag 210 (and by "600" from foldable tag 10, shown in FIGS. 1-5). Tag 610 combines the functions of foldable tag 210 and tag 510 to prominently display items retained in pocket 616 (e.g., when film 628 is transparent), where pocket 616 is configured to expand with neat fold lines due to slits 652. Accordingly, foldable tag 610 may retain larger items while maintaining good adhesion between rear segment 620 and film 628 at sealed borders 630.

As discussed above, each foldable tag of the present disclosure (e.g., foldable tags 10, 210, and 410) and non-foldable tags of the present disclosure (e.g., tags 510 and 610) may be used for a variety of purposes, such as a product tag for labeling food products or other retail products, as well as gift tags for packages, or for attachment to an article for other purposes. Pockets 16, 216, 416, 516, and 616 for each tag 10, 210, 410, 510, and 610 are suitable for retaining one or more removable items, such as coupons, advertisements, product samples, and the like.

This allows tags 10, 210, 410, 510, and 610 to display information on tag portions 12, 212, 412, 512, and 612 and include additional, removable items in pockets 16, 216, 416, 516, and 616. As such, even after tags 10, 210, 410, 510, and 610 are manufactured and tag portions 12, 212, 412, 512, and 612 retain fixed printed indicia and graphics, items may be interchangeably inserted into and retained by pockets 16, 216, 416, 516, and 616, such as updated coupons, advertisements, and/or samples.

Figure 17:
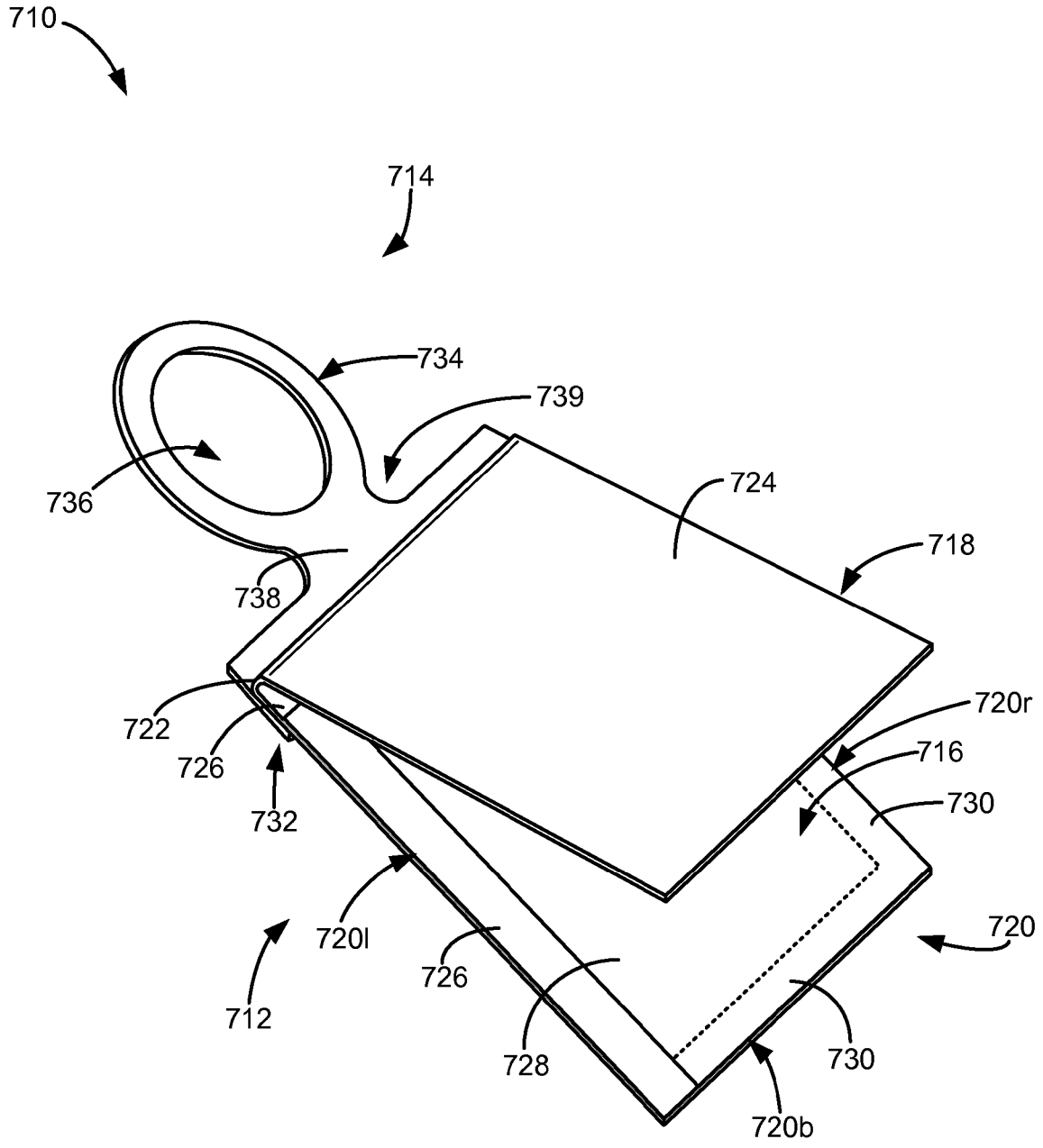
FIG. 17 is a perspective illustration of a sixth alternative foldable tag of the present disclosure having an expandable loop and a pocket, where the pocket extends from a lateral side.

In additional alternative embodiments, the openings in the pockets (e.g., 16, 216, 416, 516, and 616) may extend from different directions. For example, as shown in FIG. 17, for foldable tag 710, which is foldable tag similar to foldable tag 10 (shown in FIGS. 1-5), and where the reference numbers of the corresponding components are increased by "700" from foldable tag 10, pocket 716 is unsealed adjacent to left edge 720*l* (or, alternatively, adjacent to right edge 720*r*) to allow items to be inserted laterally into pocket 716. This is suitable for use with automated filler equipment that are configured to laterally insert items into pocket 716. In this example, the top and bottom ends of pocket 716 may be sealed.

Alternatively, the bottom side of pocket 16 may be unsealed to allow items to be inserted into pocket 16 from the bottom direction, if desired. A variety of different combinations may be utilized to accommodate the insertions of particular items. In further additional alternative embodiments, the pockets (e.g., 16, 216, 416, 516, and 616) may be formed on the rear surfaces of the tag portions, desirably below the bonding segments of the elastomer portions.

Further examples of the labeling tags of the present disclosure and their uses are disclosed in U.S. Provisional Patent Application No. 61/416,129, filed on Nov. 22, 2010, and entitled "Foldable Tag With Expandable Loop And Pocket, And Method Of Manufacture"; and of U.S. Provisional Patent Application No. 61/522,100, filed on Aug. 10, 2011, and entitled "Labeling Tag With Expandable Loop And Pocket, And Method Of Manufacture"; the disclosures of which are incorporated by reference in their entireties.

Although the present disclosure has been described with reference to preferred embodiments, workers skilled in the art will recognize that changes may be made in form and detail without departing from the spirit and scope of the disclosure.

The invention claimed is:

1. A method for manufacturing multiple labeling tags, the method comprising:

advancing a web of a tag material in a longitudinal direction, the web having a front surface and a rear surface;

laminating a film over a first segment of the front surface of the web, wherein a second segment of the web is free of the laminated film;

bonding portions of the film to the front surface of the web to define multiple pockets, wherein each pocket has an inlet opening at which the film is unbonded to the front surface of the web;

folding the second segment of the web over the first segment of the web to define a longitudinally-extending fold line, wherein the folded second segment covers at least a portion of the pockets, and wherein the inlet openings of the pockets are located adjacent to the longitudinally-extending fold line;

laminating an elastomer film to the rear surface of the web to form a bonding zone between the elastomer film and the rear surface of the web adjacent to the longitudinally-extending fold line;

cutting the laminated elastomer film to form multiple expandable loops; and forming lines of weakness in the front and rear segments of the web and in the bonded film to define the multiple labeling tags, wherein each of the multiple labeling tags includes one of the pockets and one of the expandable loops.

2. The method of claim 1, wherein, prior to folding the second segment of the web over the first segment of the web, forming section holes through the first segment of the web and the bonded film to define cut sections for each of the multiple labeling tags, wherein each cut section defines a slit opening into one of the pockets.

3. The method of claim 2, wherein the formed section holes do not extend through the second segment of the web.

4. The method of claim 2, wherein the formed section holes each have a diamond geometry with vertices, and wherein the formed lines of weakness are substantially aligned with the vertices of the diamond geometry of the formed section holes.

5. The method of claim 1, wherein cutting the elastomer portion further forms a transition portion for each labeling tag that is configured to disperse tension force created when the expandable loop of an associated labeling tag is stretched.

6. The method of claim 1, and further comprising:

separating a labeling tag from the multiple labeling tags;

unfolding the second segment of the separated labeling tag from the first segment of the separated labeling tag; and inserting an item through the inlet opening of the pocket of the unfolded labeling tag.

* * * * *